US005896926A

United States Patent [19]

Hama et al.

[11] Patent Number: 5,896,926

[45] Date of Patent: Apr. 27, 1999

[54] PACKER TYPE GROUNDWATER SAMPLING SYSTEM AND WATER SAMPLING METHOD

[75] Inventors: Katsuhiro Hama, Gifu; Toshihiro Seo, Gifu; Koichi Yanagisawa, Gifu; Katsushi Nakano, Gifu; Hiroshi Mori, Tokyo; Yukifusa Nakashima, Tokyo; Yukio Sakai, Tokyo; Kenji Teshima, Tokyo, all of Japan

[73] Assignees: Doryokuro Kakunenryo Kaihatsu Jigyodan; Kiso-Jiban Consultants Co., Ltd., both of Tokyo, Japan

[21] Appl. No.: 08/679,633

[22] Filed: Jul. 10, 1996

[30] Foreign Application Priority Data

Jul. 10, 1995 [JP] Japan ..... 7-173364

[51] Int. Cl.[6] ..... E21B 47/00

[52] U.S. Cl. ..... 166/250.07; 166/264

[58] Field of Search ..... 166/250.07, 264, 166/106, 187, 191, 319

[56] References Cited

U.S. PATENT DOCUMENTS 5,540,280 7/1996 Schultz et al. ..... 166/264 X

FOREIGN PATENT DOCUMENTS 3-69090 7/1991 Japan .

6-201542 7/1994 Japan .

*Primary Examiner*—William Neuder

*Attorney, Agent, or Firm*—Armstrong, Westerman Hattori, McLeland and Naughton

[57] ABSTRACT

The present invention provides a system and a method for sampling groundwater under in-situ condition state in reliable, efficient and economic manner without disturbing environment of formation water present in under-ground layer. There are provided a continuous water sampling process and a batch style water sampling process for sampling formation water by confirming the same environment as that of the groundwater in the under-ground layer. After drilling water has been removed by the continuous water sampling process, formation water is repeatedly sampled by the batch style water sampling process, and a downhole system equipped with the continuous water sampling process and the batch style water sampling process is designed in such structure that it is moved up and down in a casing pipe and inserted into or removed from a packer system in the hole.

8 Claims, 19 Drawing Sheets

FIG.19

CONTINUOUS WATER SAMPLING OPERATION

| WORKING TIME | WATER PUMPING QUANTITY | AVERAGE WATER PUMPING SPEED |
|---|---|---|
| 2,645 min. | 201 LITERS | 76.0 cc/min. |

FIG.20

BATCH TYPE WATER COLLECTING OPERATION

| OPERATIONS | TIME OF INSERTION (min.) | TIME FOR WATER SAMPLING (min.) | TIME FOR PULLING UP (min.) | WORKING TIME FOR EACH OPERATION (min.) | WATER SAMPLING QUANTITY (cc) |
|---|---|---|---|---|---|
| NO. 1 | 57 | 30 | 64 | 151 | 500 |
| NO. 2 | 62 | 29 | 61 | 152 | 500 |
| NO. 3 | 61 | 26 | 62 | 149 | 500 |
| NO. 4 | 62 | 29 | 59 | 150 | 500 |
| NO. 5 | 58 | 27 | 61 | 146 | 500 |
| NO. 6 | 60 | 28 | 63 | 151 | 500 |
| NO. 7 | 59 | 27 | 57 | 143 | 500 |
| NO. 8 | 61 | 32 | 57 | 150 | 500 |
| NO. 9 | 59 | 28 | 61 | 148 | 500 |
| NO. 10 | 59 | 32 | 72 | 163 | 500 |

TOTAL FOR 10 OPERATIONS: 1,503 min. 5,000 cc

TIME FOR SURVEY: 4,148 min.

WATER VOLUME BROUGHT TO GROUND SURFACE: 206 LITERS

PACKER TYPE GROUNDWATER SAMPLING SYSTEM AND WATER SAMPLING METHOD

BACKGROUND OF THE INVENTION

The present invention relates to a packer type groundwater sampling system, which can be used for an apparatus for sampling groundwater in a borehole or a well or for an apparatus for carrying out test at any desired depth in a borehole or a well. The invention also relates to a method for sampling groundwater using such a system.

Continuous water sampling method has been used for sampling groundwater in the past. A typical method is a pumping-up method. In this method, a pump is installed in a probe placed in a borehole, and groundwater in a water sampling section is continuously sampled and brought up to the ground surface. Also, an air-lift method using air pressure from ground surface is known as one of the continuous water sampling methods.

On the other hand, a batch style water sampling method has also been proposed (Japanese Utility Model Publication Laid-Open 3-69090 and Japanese Patent Publication Laid-Open 6-201542). In this method, a completely sealed water sampling container is used to characterize groundwater chemistry and water can be sampled under in-situ condition.

Also, a water sampling apparatus has been proposed, which combines the above two methods to overcome the disadvantages of these methods (Japanese Patent Publication Laid-Open 6-193101).

The pumping-up method, i.e. the most typical of the continuous water sampling methods, is higher in working efficiency than the batch style water sampling method. However, because pumping ability of the pump is effective for the depth of several hundreds of meters in the current technical level, water cannot be pumped up if the groundwater level in borehole is lower than the limit of the pumping ability.

Also, because it is impossible to sample groundwater under in-situ condition from structural reason, there are problems in that dissolved gas in the groundwater is released at the ground surface when it is opened to the atmospheric air due to pressure change. Further, because water is sampled continuously for long time, load applied on the pump is high, and this extensively reduces durability of the pump.

In the air-lift method, compressed air sent from the ground surface is used, and it is impossible to sample groundwater in in-situ condition.

By the batch style water sampling method, it is possible to sample formation water under in-situ condition without disturbing geological environment where the groundwater is present. However, it is not possible to strictly judge whether the formation water under in-situ condition has been sampled or not unless there is the function to confirm that the pressure in the container for sampling groundwater has reached the same level as the underground condition.

Also, in the practical procedure, drilling fluid has been used for the drilling of boreholes and the groundwater will be contaminated by this fluid. The absence of drilling fluid in water has been checked by continuous monitoring of:

(1) concentration of tracers (e.g. Uranine dye or Li) which are introduced into the drilling fluid; and (2) concentration of chemical components.

The absence of tracers, or constant concentrations of chemical components can be regarded as an indication of the absence of drilling fluid. Water sampling volume per batch is also low, and much time is required to carry out the work by this method alone, and there is also problems in working efficiency.

On the other hand, the combination of the continuous water sampling method and the batch style water sampling method is not yet used in practical application, but it overcomes the disadvantages of these two methods. By this method, however, formation water necessary for water quality analysis is sampled by one time in the batch style water sampling method. If the required quantity has not been sampled, the water sampling section is sealed off for once and the water is mixed with the groundwater of the other level when the second batch style water sampling is carried out. Thus, the continuous water sampling must be carried out again. Further, in case water chemistry is to be monitored over a long period, the continuous water sampling and the batch style water sampling must be performed each time, and problems arise about quality or economic feasibility of the sampled groundwater. Also, there are problems in that the formation water sampled and brought to ground surface by the batch style water sampling method cannot be easily taken out and transported.

In testers in a borehole, there are hydrological tester, pore water pressure measuring apparatus, flow direction and velocity measuring apparatus, borehole expansion tester, etc. in addition to groundwater sampler. In major functions of these apparatuses, there are the following problems at present:

(a) Packer structure

The tester in the borehole normally uses packer or mechanical packer based on water pressure or air pressure to set up a measuring section. As depth increases, water packer is used because of safety and maneuverability. In the conventional type water packer structure, there are the following problems:

- Because diameter of water supply hose in the packer expansion system is small, pressure loss inside the pipe increases, and longer time is required for expansion of the packer.
- To expand the packer, water in hose (such as tap water), and not in-hole water (i.e. mixture of groundwater at various depths in a borehole), is used in many methods. In this case, if leakage occur, water other than the in-hole water is brought into the hole, and this results in contamination of the groundwater in the borehole.
- When the level of groundwater in borehole is lowered, packer is spontaneously expanded due to water pressure from ground surface to the level of groundwater. As a result, it is difficult to recover the packer.

(b) Installation of pipes and signal cable

- In many cases, water supply hose of the packer expansion system is installed outside casing pipe. This causes damage of wall of borehole and makes it difficult to recover the apparatus. Also, much time is required for installing hoses and cables, leading to lower working efficiency.
- Because water hose is present in a packer expansion circuit system, volume inside the hose and volume change due to creeping of hose are also included in water injection quantity, and it is not possible to accurately identify quantity of water injected into the packer itself.

Also, it is difficult to identify quantity of the water extracted from the packer.

To solve the above problems, it is an object of the present invention to develop and provide a water sampling system, by which it is possible to sample formation water under in-situ condition at deeper depth reliably, efficiently and economically without disturbing geological environment of groundwater present in underground formation by means of borehole.

It is another object of the present invention to limit a water sampling section to a certain depth, to quickly discharge drilling water and other water mixed with water of the other level from the sampling section and to replace them with the formation water.

It is still another object of the present invention to sample the formation water under in-situ condition.

It is another object of the present invention to sample the formation water by batch style water sampling method continuously and by many times without carrying out continuous water sampling after the groundwater in the water sampling section has been replaced with the formation water.

It is another object of the present invention to make it possible to confirm that pressure in a water sampling container is in equilibrium with water pressure environment where the formation water has been present in the batch style water sampling method and to confirm water sampling volume in the water sampling container in order to reliably perform water sampling under in-situ condition.

It is still another object of the present invention to make it possible to easily take out formation water sampled and brought to ground surface by the batch style water sampling method and to transport the water under in-situ condition.

It is another object of the present invention to make the packer expandable by utilizing in-hole water in order to reliably and safely limit the water sampling section without disturbing the geological environment where the groundwater is present.

It is still another object of the present invention to make it possible to sample and bring groundwater safely to ground surface by protecting major functional components even when it is not possible to recover the packer system due to collapse occurring in the borehole.

SUMMARY OF THE INVENTION

The packer type groundwater sampling system according to the present invention comprises a casing pipe, where a packer system having an upper packer and a lower packer with a water sampling filter placed therebetween is installed at the bottom end of the casing pipe, a downhole system comprising a connecting unit, a water sampling unit and a water pumping unit, inserted into the casing pipe and connected with said packer system by the connecting unit, and a control unit installed at the ground surface and used for controlling the downhole system, whereby said connecting unit has a water sampling section water flow passage with a formation water pressure gauge connected thereto and a water flow passage switching valve for switching a packer water flow passage with a packer pressure gauge connected therewith, said water sampling unit has a water sampling container where a line from the water flow passage switching valve of the connecting unit and the pressure in a water sampling container gauge are connected, and said water pumping unit has a water flow passage switching valve connected to a line from the water flow passage switching valve of the connecting unit and has a water flow passage switching valve used for switching the line from the connecting unit to ground surface or to the hole and a pump, which can be switched in two directions by a pump switching valve.

The present invention is characterized in that the connecting unit comprises a tapered portion being at symmetrical position of±180° at its tip and having a key groove to connect a guide key mounted on the casing pipe at its tip, and when the downhole system is inserted and when said tapered portion and the guide key are brought into contact, the connecting unit is rotated along the tapered portion until the guide key is engaged in the key groove.

The present invention is also characterized in that a range finder for measuring the distance from the packer system is provided at the tip of the connecting unit.

The packer type groundwater sampling method of the present invention comprises a step for installing a casing pipe in a borehole, said casing pipe having a packer system consisting of an upper packer and a lower packer with a water sampling filter placed therebetween and being installed at its tip, a step for inserting a downhole system into the casing pipe and for connecting it to the packer system by a connecting part, said downhole system comprising a connecting unit having a water flow passage switching valve for switching a water sampling section water flow passage where a pore water pressure gauge is connected and a packer water flow passage, the water flow passage switching valve of the connecting unit, and a water pumping unit having a pump connected to a line from the water flow passage switching valve from the connecting unit and having a water flow passage switching valve to switch the line from the connecting unit to ground surface or to downhole unit and a pump, which can be switched in two directions by a pump switching valve, a step for switching the water flow passage switching valve of the connecting unit to the packer circuit, for selecting the water flow passage switching valve of the water pumping unit to ground surface or to downhole unit and for setting the water sampling section by increasing packer pressure to a predetermined value by the pump and by expanding the upper and the lower packers, a step for switching the water flow passage switching valve of the connecting unit to the water sampling section flow passage, for selecting the water circuit switching valve of the water pumping unit to ground surface or to downhole unit and for continuously sampling water until the water sampling section is filled with formation water by operating the pump in water pumping direction, a step for stopping the pump when it is judged that in-hole water in the water sampling section has been replaced with the formation water and for closing valves of the water pumping unit and the connecting unit, and a step for sampling water by continuous water sampling using the water pumping unit or by the batch style water sampling using the water sampling unit.

Also, the present invention is characterized in that expanded conditions of the upper packer and the lower packer are maintained and water sampling in the same water sampling section is repeatedly performed by moving the downhole system up and down.

The system of the present invention is capable to sample groundwater present in deep geological formation in a borehole in reliable, safe and efficient manner without disturbing environment.

The method for sampling groundwater according to the present invention comprises two processes, i.e. a continuous water sampling process using pumping-up for continuously and efficiently sampling groundwater and a batch style water sampling process for confirming the same environment as that of groundwater in underground layer and for sampling formation water, whereby the formation water after removing drilling water by the continuous water sampling process can be repeatedly sampled as necessary, and the water sampling container can be easily removed and transported.

The downhole system based on the continuous water sampling method and the batch style water sampling method is designed in such structure that it can be inserted into or removed from a packer system in the hole by moving it within a casing pipe, and the downhole system serving as a main functioning unit can be safely collected and recovered even when the packer system cannot be recovered due to collapse in the hole. When inserting or removing it, a self-removing closed coupler is used in the packer in the hole and in the circuit of water sampling section, and leakage of the packer water does not occur or groundwater in the water sampling section is not contaminated.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIG. 19 explains improvement of working efficiency in continuous water sampling; and FIG. 20 shows water sampling volume by the batch style water sampling.

DETAILED DESCRIPTION OF THE PREFERRED EMBODIMENT

Figure 1:
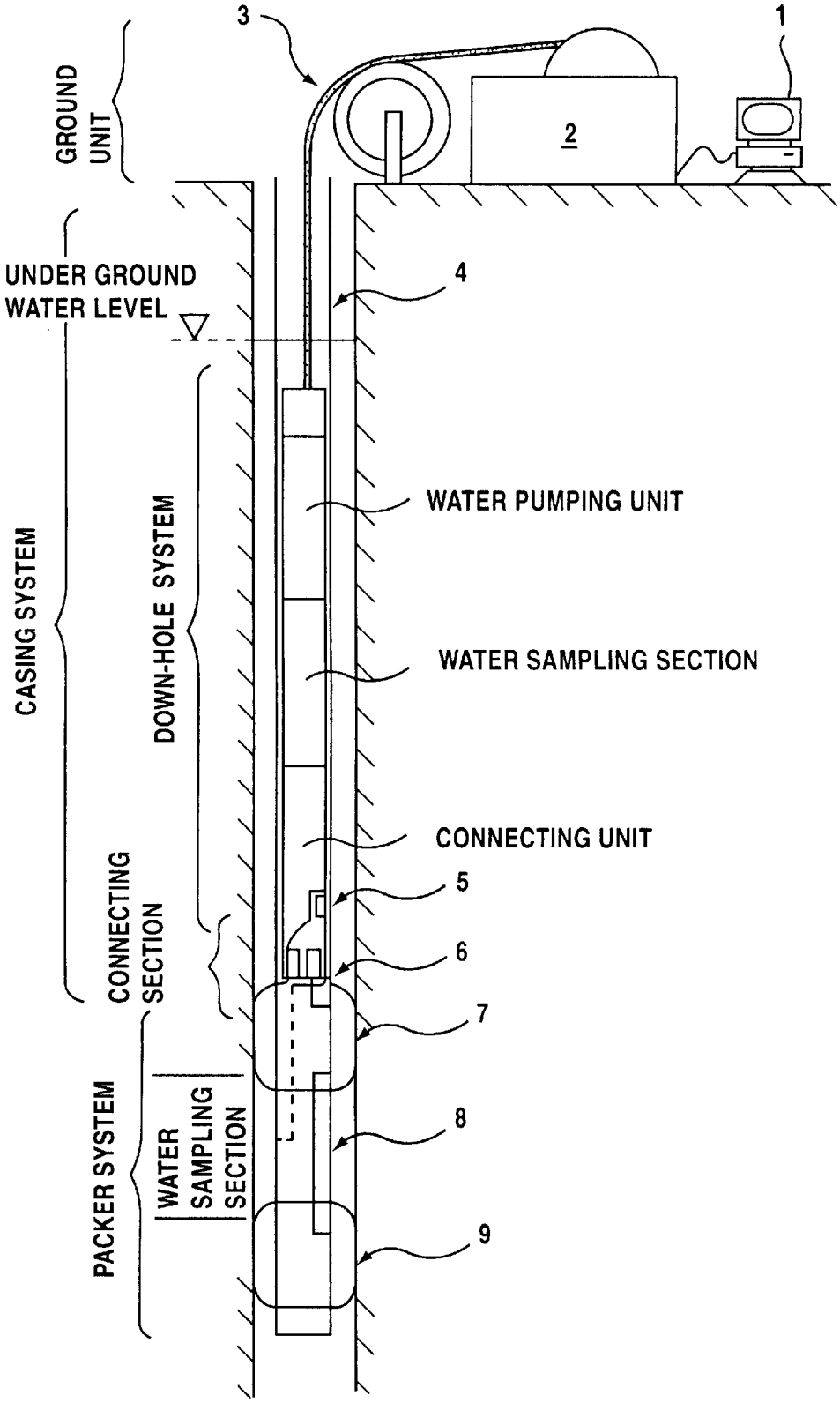
FIG. 1 shows an overall arrangement of a system according to the present invention.

In the following, description will be given on an embodiment of the present invention referring to the drawings.

FIG. 1 shows an overall arrangement of a system according to the present invention.

The groundwater sampling system of the present invention comprises a surface unit, a casing system, a packer system and a downhole system.

In a borehole formed by drilling, there is provided a casing pipe 4 where a plurality of pipes are connected by screw connection and the number of connected pipes is increased to extend the pipes to a given depth. This is used for in-hole installation of the packer system and for protection of the in-hole or downhole system when it is moved up and down. This arrangement is called a casing system.

At the tip of the casing pipe 4, an upper packer 7 and a lower packer 9 made of natural rubber and communicated with a connecting pipe are mounted by screw connection. By pouring or sampling water through a pump of a water pumping unit, the packers are expanded or compressed, thus shielding and limiting water sampling section. A water sampling filter 8 for dust prevention is installed between the packers to prevent suspended solids and precipitates in the water sampling section from entering the in-hole or downhole system. These components constitute the packer system. On top of the packer system, the downhole system is connected, which comprises a water pumping or discharging section, a water sampling or collecting unit and a connecting unit suspended from the surface unit by a composite cable 3. The details of connection between the downhole system and the packer system will be described later. When the downhole system is moved down, a tapered portion installed at symmetrical positions of ±180° on the outer periphery of the pipe of the connecting unit is brought into contact with a guide key 5 of the casing pipe 4. Then, the downhole system is rotated along the tapered portion until the guide key 5 is engaged in a key groove at tapered end, thus fixing the position and connecting the two components. In this case, concave and convex connecting couplers 6 are engaged with each other, and a packer water flow passage and a water sampling water flow passage are formed. (The details are to be described later.)

The surface unit comprises a water flow passage hose, an optical fiber cable for communication, a cable winding unit 2 used for delivering and winding up the composite cable 3 incorporated with power supply line used for moving the downhole system up and down, and a control and communication unit for controlling the downhole system and for monitoring communication data.

By the system arrangement as described above, the upper packer 7 and the lower packer 9 are expanded by the control from the surface unit to limit the water sampling section in the borehole. Drilling water or mixed water from the other level present in the section are discharged to ground surface or to the place beyond the water sampling section by the pump in the water pumping unit and are quickly replaced with formation water. After the groundwater in the water sampling section has been replaced with the formation water, the formation water in in-situ condition is moved and sampled and brought to ground surface by a perfectly sealed water sampling container (500 cc) incorporated in the water sampling unit.

Figure 2:
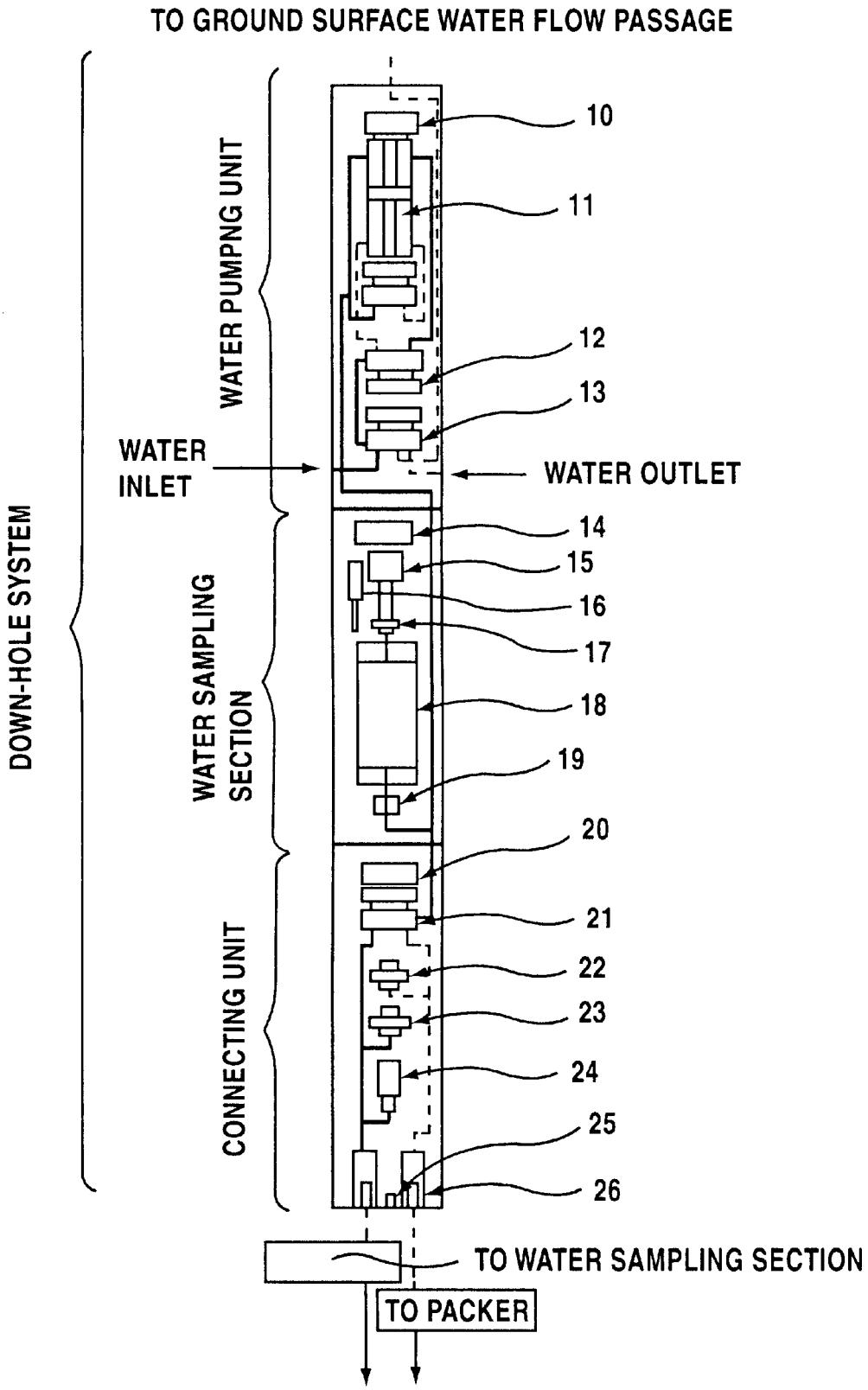
FIG. 2 shows an arrangement of a downhole system.

Next, description will be given on each of the units in the downhole system referring to FIG. 2.

The water pumping unit is incorporated with the pump 11 having water suction and discharge functions and controls the packer and performs continuous water sampling. A control amplifier 10 controls the packers and operation of a water flow passage switching valve 13 and the pump 11 when continuous water sampling is performed, and it also communicates with the ground surface. The pump 11 has the water suction and discharge functions and normally sucks in-hole water through a water inlet and discharges water into the hole through a water outlet to open or close the packer. It is also operated in water pumping direction to sample water continuously. A pump switching valve 12 is a valve for operating the pump in water suction or water discharging directions. The water flow passage switching valve 13 switches the water flow passage selected by the connecting unit to ground surface or to borehole.

The water sampling unit is designed as a batch style water sampling mechanism for sampling the formation water, to be investigated in in-situ condition, into a water sampling container 18 incorporated in it. A control amplifier 14 controls a driving motor 15, picks up data of a pressure in a water sampling container gauge 17 and a displacement gauge 16, and communicates with the surface unit. The driving motor 15 is a driving source for inserting and removing the water sampling container 18 and a double-sided needle 19. The displacement gauge 16 is to confirm the position of the water sampling container 18 inserted or removed by the driving motor 15. The pressure in a water sampling container gauge 17 measures pressure in the water sampling container and confirms initial pressure. At the same time, it confirms that the pressure in the water sampling container has increased to the pore water pressure and the formation water has been sampled under in-situ condition in the water sampling container. By this pressure measurement, water sampling volume in the water sampling container can be identified. The water sampling container 18 is a container to sample the formation water under in-situ condition in the water sampling section. The double-sided needle 19 is used to insert or remove the water sampling container 18 and the water flow passage in the water sampling section. The connecting unit connects the downhole system with the packer system and switches to the packer water flow passage and to the water sampling section water flow passage. The control amplifier 20 communicates with the surface unit and controls the water flow passage switching valve 21, and further transmits data of a packer pressure gauge 22, a formation water pressure gauge 23, an downhole thermometer 24, and a range finder 25 to the surface unit. The water flow passage switching valve 21 is a valve for switching over the water flow passage to the packer water flow passage and to the water sampling section water flow passage. The packer pressure gauge 22 is used to measure packer pressure, and the formation water pressure gauge 23 is used to measure formation water pressure. The downhole thermometer 24 is used to measure downhole temperature. The range finder 25 is to measure connecting distance between the downhole system and the packer system when they are connected. The concave connecting coupler 26 is a self-removing type closed coupler and connects the downhole system with the water flow passage of the packer system. Because it is a closed coupler, the packer water flow passage and the water sampling section water flow passage are closed when the systems are not connected. Accordingly, leakage of the packer injection water does not occur, and groundwater in the water sampling section is not contaminated. (See below for the details.)

Figure 3:
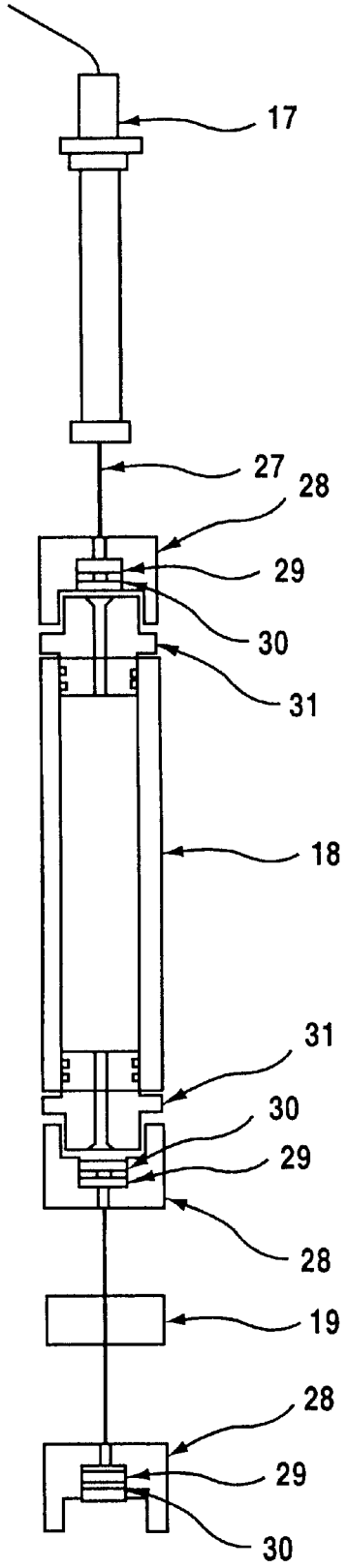
FIG. 3 shows an arrangement of a water sampling unit.

FIG. 3 is a drawing for explaining the water sampling unit.

Both ends of the water sampling container 18 of the water sampling unit are closed by caps 28 via cap joints 31. Each of the cap joints 31 is in contact with end surface of the water sampling container and is closely engaged with inner surface of the water sampling container and inner surface of the cap, and a hole to penetrate its center is formed. On each of the caps 28, a through-hole is formed at a position to match the through-hole of the cap joint 31. A rubber disk 29 is packed in the cap with a Teflon washer 30 therebetween, thereby closing the through-hole and blocking the water sampling container from external environment. A needle 27 mounted on the lower end of the pressure gauge 17 and a double-sided needle 19 are positioned face-to-face to the through-holes on the upper cap, and the lower cap respectively. A cap 28 of the same structure is arranged on the water sampling section opposite to the double-sided needle 19. The water flow passage to the water sampling section and to the pressure gauge 17 can be opened by pricking the needle 27 and the double-sided needle 19 into the rubber disks 29.

Figures 4A, 4B, 4C, 4D:
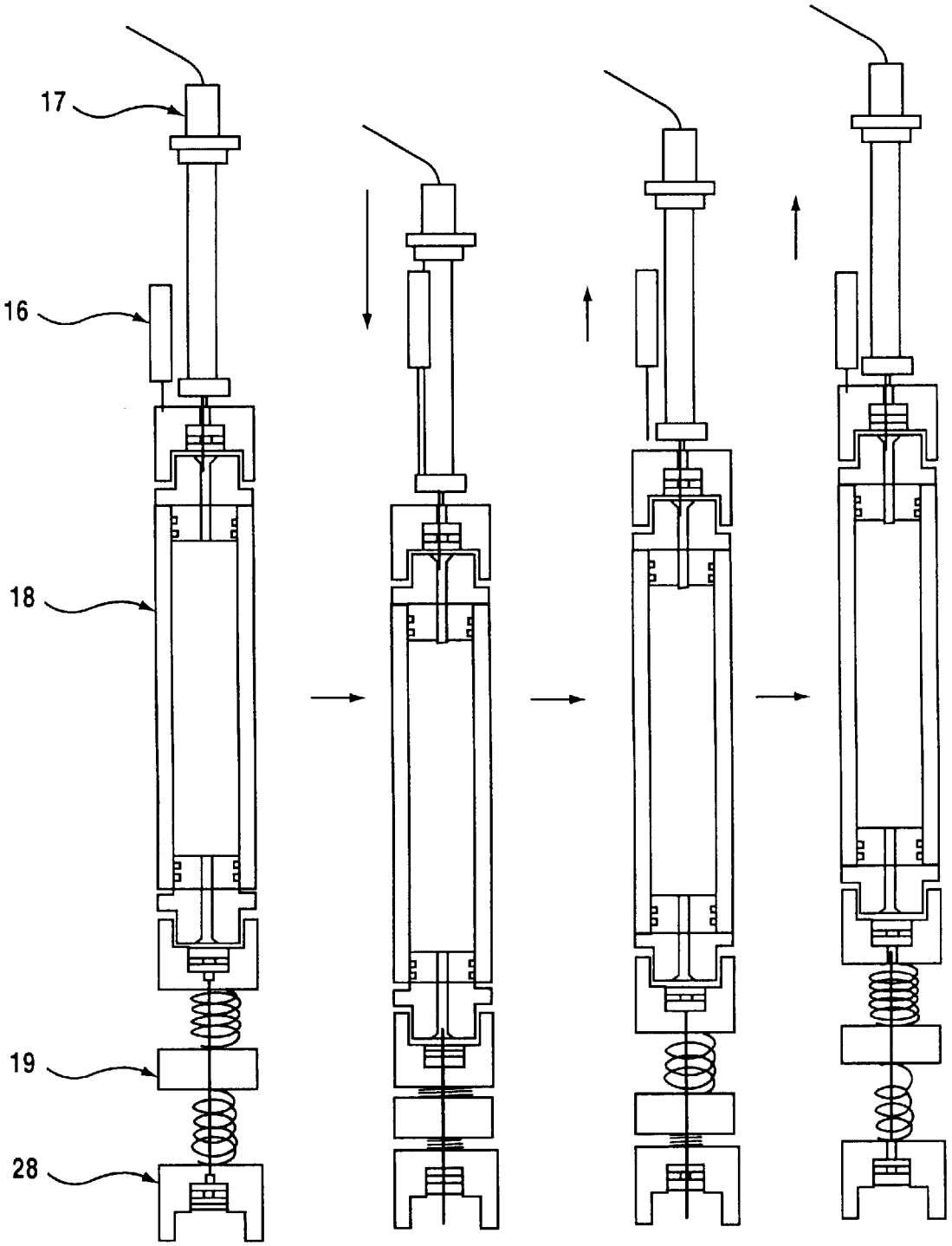
FIG. 4 shows a batch style water sampling mechanism of the water sampling unit.

Description is now given on the batch style water sampling mechanism of the water sampling unit in connection with FIG. 4. By penetrating the needle 17 through the through-hole of the cap 28 on upper end of the water sampling container and through the rubber disk 29,the pressure in a water sampling container gauge 17 is communicated with-the water sampling container 18, and pressure in the water sampling container is monitored (FIG. 4(*a*)). Further, by pushing the pressure gauge 17 by motor driving, the double-sided needle 19 penetrates through the rubber disk 29 on the cap between the water sampling container and the water sampling section. As a result, the water sampling container is communicated with the water sampling section, and the formation water is introduced into the water sampling container by differential pressure (FIG. 4(*b*)). In this case, the displacement of the pressure in a water sampling container gauge is measured by the displacement gauge 16 mounted on the side of the pressure in a water sampling container gauge 17. In this measurement, a change of 0 to 70 mm can be measured by variable resistance method, and the displacement required for water sampling is 60 mm or more. After confirming the pressure in the water sampling container where the formation water has been sampled, the pressure in a water sampling container gauge 17 is moved up (FIG. 4(*c*)). When the double-sided needle 19 is withdrawn, communication of the space inside the water sampling container 18 with outside is blocked by the rubber disk 29, and the in-situ condition is maintained (FIG. 4(*d*)).

Next, description will be given on connection between the downhole system and the packer system referring to FIG. 5 to FIG. 8.

Figure 5A:
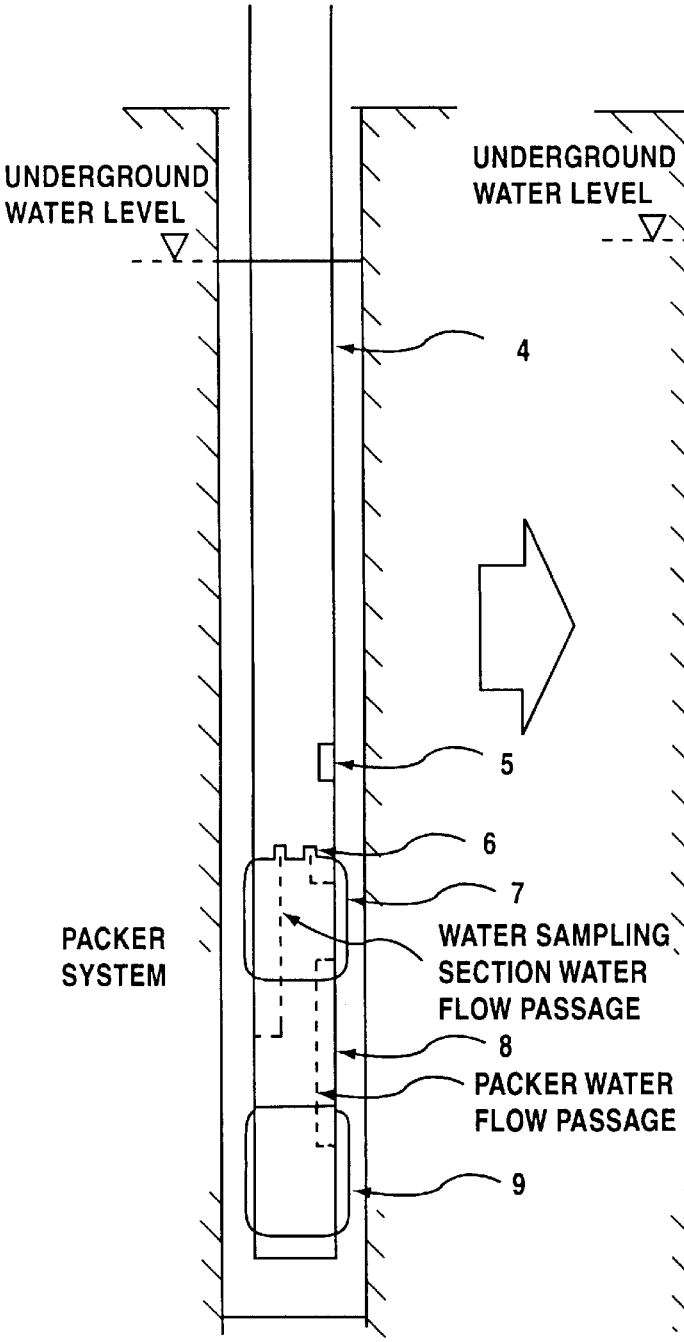
FIG. 5 shows insertion of the downhole system.
Figure 5B:
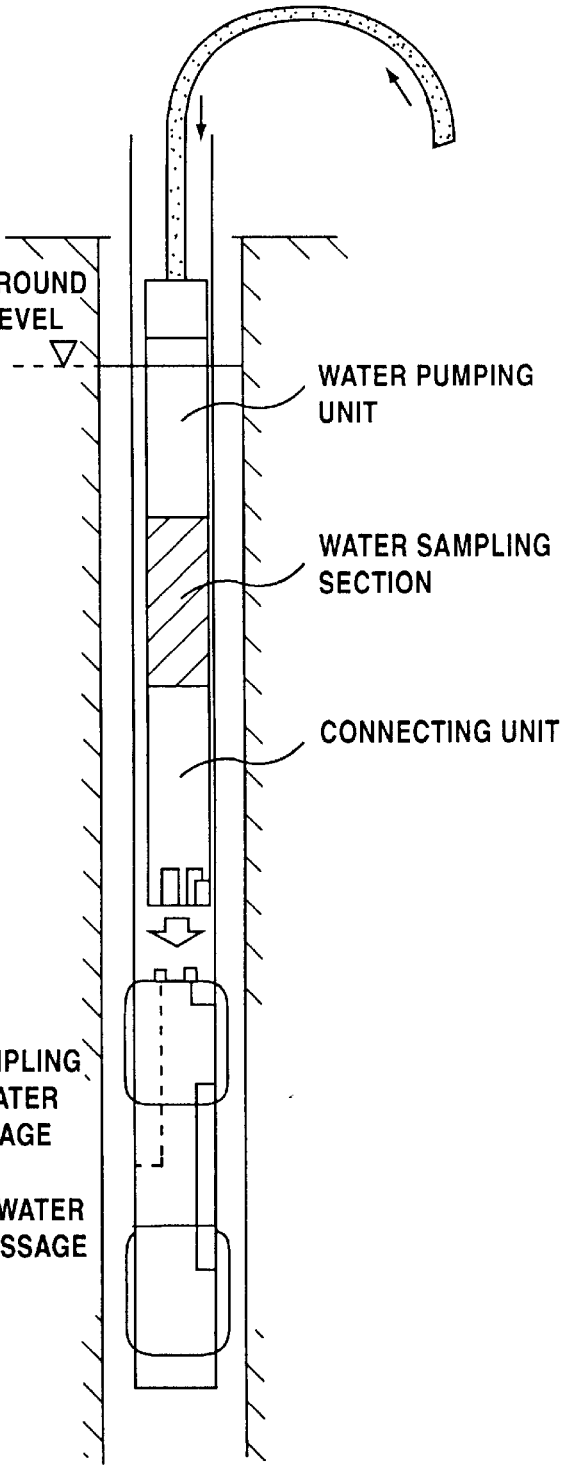

First, as shown in FIG. 5(*a*), the lower packer 9, the water sampling filter 8, the upper packer 7 and the casing pipe 4 are placed in the borehole, and after reaching the predetermined depth, these are fixed from the ground surface. Next, the downhole system shown in FIG. 2 is placed into the casing pipe 4 installed in the borehole (FIG. 5(*b*)). In this case, delivery quantity of the composite cable 3 is measured by a cable length measuring device incorporated in the cable drum unit 2, and it is inserted until the predetermined depth is reached. The downhole system and the packer system are connected by the connecting unit.

Figure 6A:
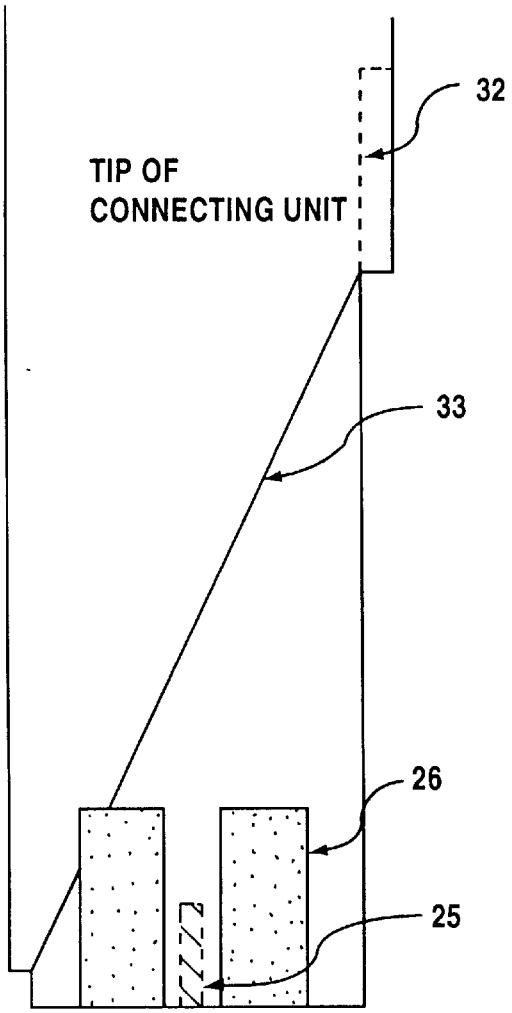
FIG. 6 represents drawings for explaining the tip of a connecting unit.
Figure 6B:
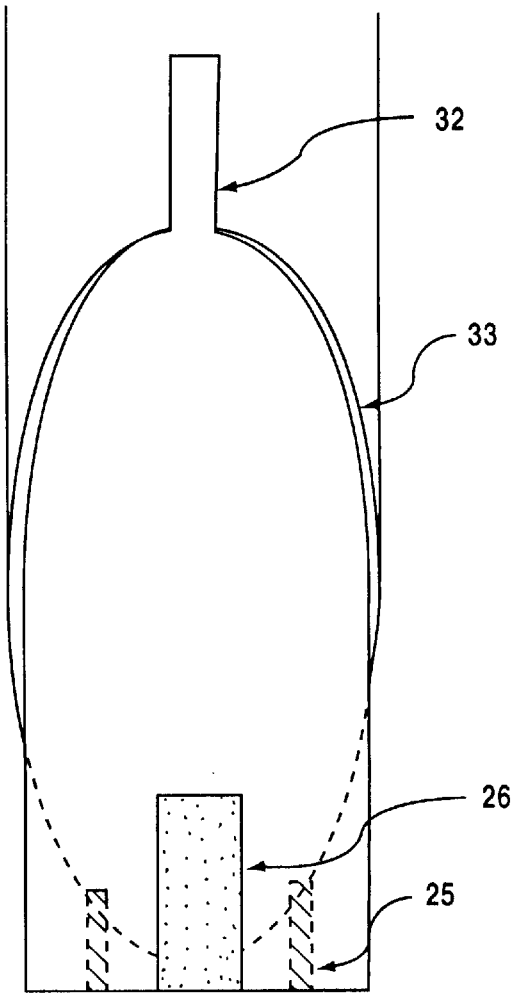
Figure 6C:
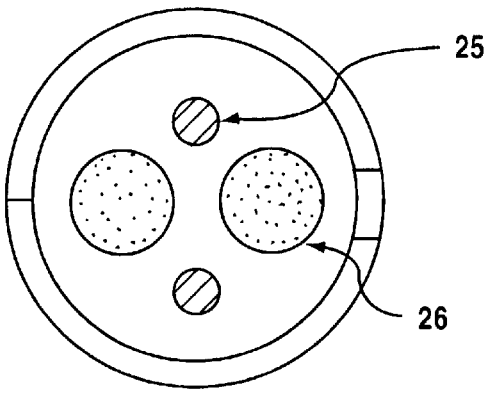

At the tip of the connecting unit, as shown in FIG. 6(*a*) (front view) and FIG. 6(*b*) (side view), a tapered portion 33 at symmetrical position of ±180° at a given inclination with a graded step of 2.5 mm in thickness is formed, and a key groove 32 is formed at the end of the tapered portion 33. In this key groove, a guide key 5 mounted on the casing pipe 4 shown in FIG. 1 is engaged. On the forward end surface of the connecting unit, as shown in FIG. 6(*c*) (plan view), concave connecting couplers 26 for the packer water flow passage and for the water sampling section water flow passage and a range finder 25 are mounted.

Figures 7A, 7B, 7C, 7D, 7E:
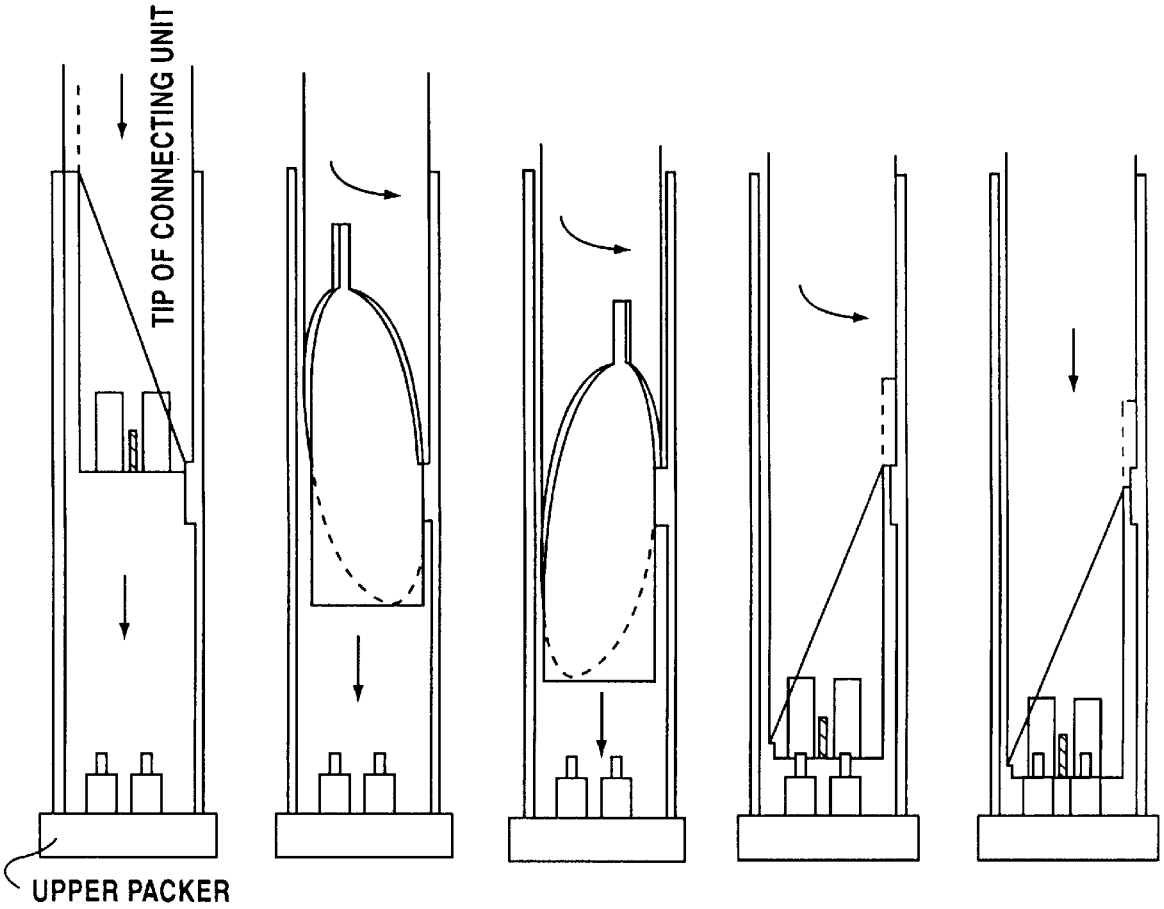
FIG. 7 represents drawings for explaining the downhole system and a packet system.

The connection between the downhole system and the packer system is described referring to FIG. 7. When the downhole system is moved down in the casing pipe 4 and the tapered portion 33 having thick section is brought into contact with the guide key 5 (FIG. 7(*a*)), the downhole system is rotated up to±180° along the tapered portion 33 (FIG. 7(*b*)→FIG. 7(*c*)→FIG. 7(*d*)), and its position is fixed. The guide key 5 is engaged in the key groove 32 and both systems are connected (FIG. 7(*e*)). When these are connected together, connecting distances of the concave connecting coupler 26 and the convex connecting coupler 6 are measured by the range finder 25 and reliable connection can be confirmed. The range finder 25 is called a gap sensor, which can measure very small distance of 0 to 3 mm by eddy current range finding method.

Therefore, at the insertion of the downhole system, numerical value on the range finder 25 sent from the connecting unit to the ground surface is checked, and it is confirmed whether the downhole system is connected with the packer system or not. If the connecting distance is not sufficient, the composite cable is delivered more, and connection is confirmed.

Figure 8A:
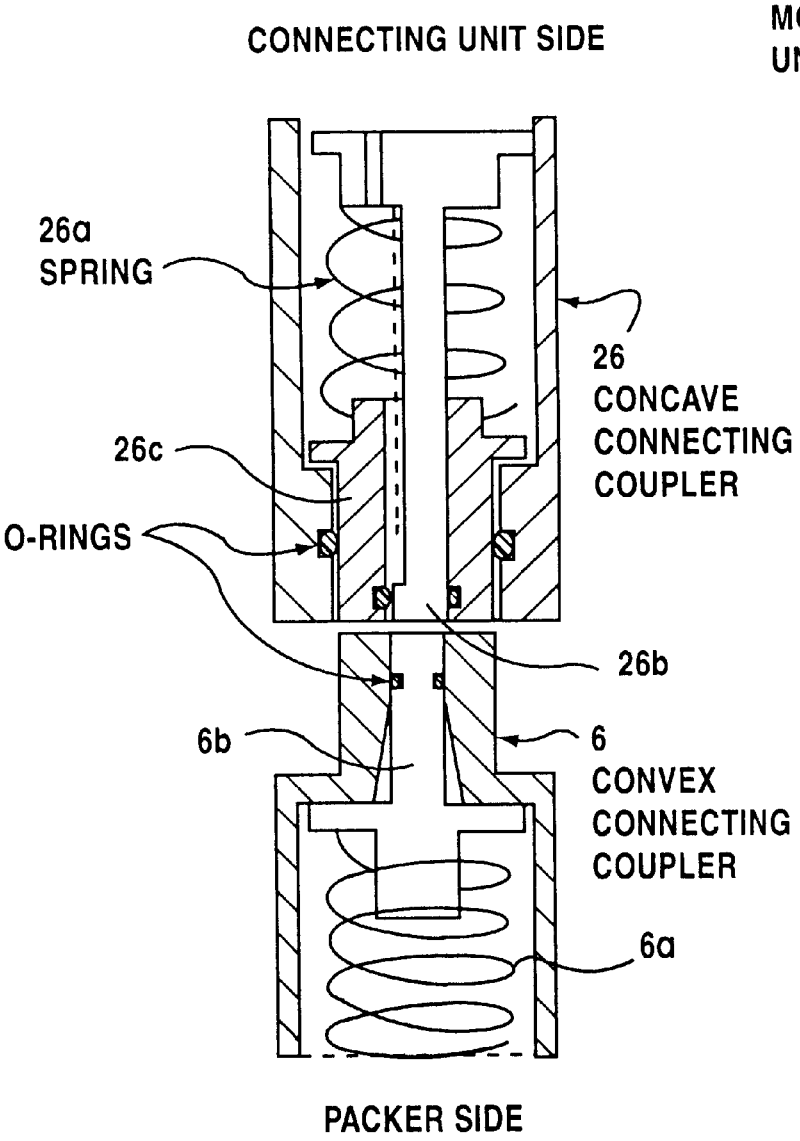
FIG. 8 represents drawings for explaining a connecting coupler.
Figure 8B:
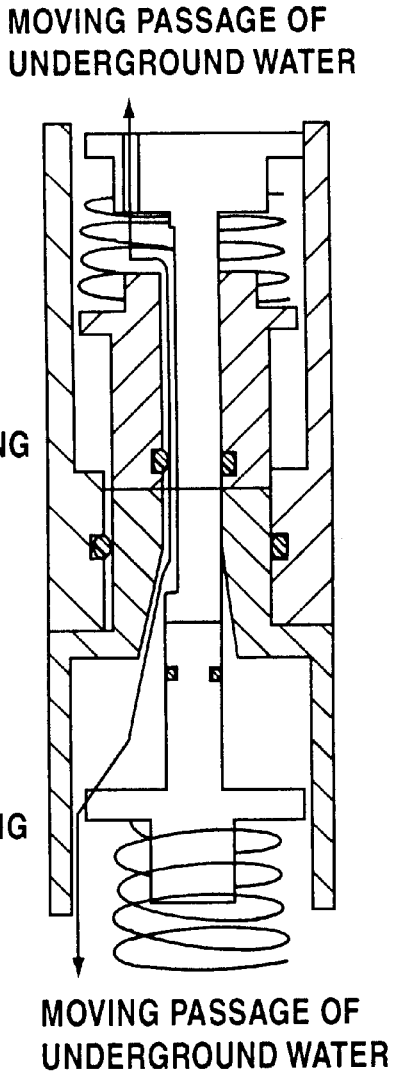

FIG. 8 represents drawings for explaining the connecting couplers. FIG. 8(*a*) shows condition before connecting, and FIG. 8(*b*) shows condition when connected.

The convex connecting coupler 6 is mounted on the packer system. When not connected, it is formed on a smaller diameter portion protruding upward from a large diameter portion. The upper opening with the diameter being reduced upward is closed by a valve disc 6*b*, which is pushed up by a spring 6*a*. An O-ring is mounted at the portion where the opening is closed by the valve disc 6*b*. On the other hand, in the concave connecting coupler 26 on the connecting unit side, a tubular valve disc 26*c* is provided to enclose periphery of a rod-like body 2*b*, which has the same diameter as the valve body 6*b* and larger diameter only at the end portion and is extended downward, and this is pushed down by a spring 26*a*. The lower opening is closed by the tip of the rod-like body 26*b* and the tubular valve disc 26*c* using an O-ring. Except the end portion, there is a gap between the rod-like body 26*b* and the tubular valve disc 26*c*. A projection to determine lower limit position is provided on the tubular valve disc 26*c*, and O-rings are provided on the portion where the tubular valve disc 26*c* contacts the rod-like body 26*b* and on inner surface of coupler opening. When the downhole system is moved down and connected, the concave connecting coupler 26 is moved down, and the rod-like body 26*b* pushes down the valve disc 6*b* and enters into the upper opening of the convex connecting coupler 6. When the lower end of the concave connecting coupler 26 hits the graded step between a large diameter portion and a small diameter portion of the convex connecting coupler 6, the two systems are perfectly connected. In this case, a gap is generated between the valve disc 6*b* or the rod-like body 26*b* and inner surface of each opening. Thus, concave connecting coupler 26 and the convex connecting coupler 6 are communicated with each other, and moving passage for the groundwater is formed as shown by arrow in the figure.

Figure 9:
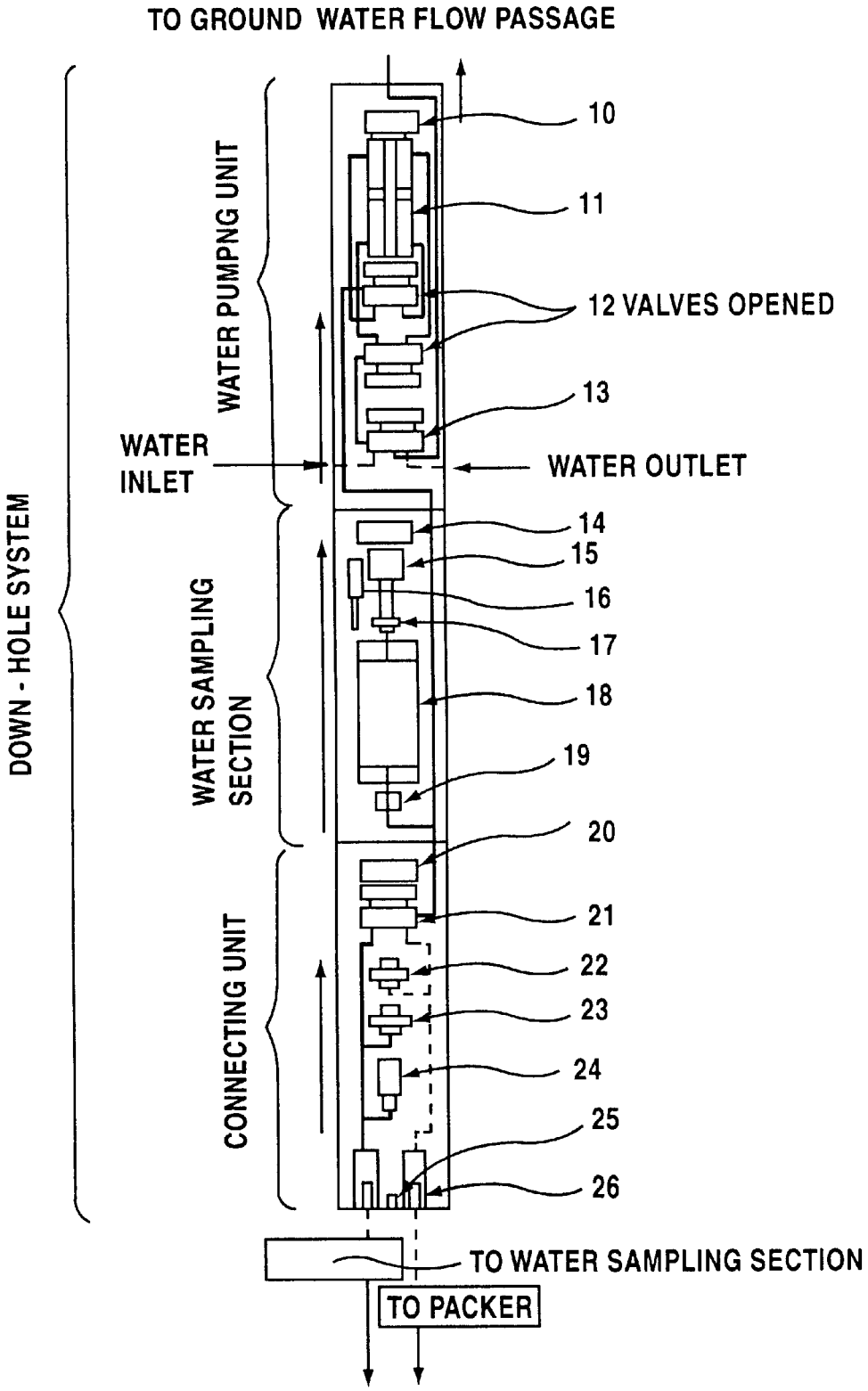
FIG. 9 shows a continuous water sampling water flow passage.

Next, description will be given on switching between continuous water sampling and batch style water sampling referring to FIG. 9.

When continuous water sampling is performed, the water sampling section is already set up. The water flow passage switching valve 21 in the connecting unit is switched to the water sampling section water flow passage and the water flow passage switching valve 13 in the water pumping unit is switched, and a line of continuous water sampling is selected on the ground surface, and the pump switching valve 12 is opened. The condition of the water water flow passage in this case is as shown by thick solid lines in FIG. 9. The pump 11 in the water pumping unit is operated in water discharging direction, and operation is continued until the downhole water in the water sampling section is completely replaced with the formation water referring to operation counter of the pump as sent from the water pumping unit (water discharge quantity is by several times to several tens of times as much as the volume of the water sampling section). To calculate the volume of the water sampling section, volume of an impermeable sector is obtained from diameter of the borehole measured in advance and from length of the water sampling section where water is blocked by the upper packer 7 and the lower packer 9, and from this result, volume of the joint connecting the filter and the upper packer 7 and the lower packer 9 is subtracted. Electric conductivity, pH and other data of the groundwater sampled on the ground surface are measured, and it is judged whether it is the formation water or the downhole water. Continuous water sampling is carried out until the downhole water in the water sampling section is completely replaced with the formation water. When judged that it is sufficient, continuous water sampling is switched to the batch style water sampling.

Figure 10:
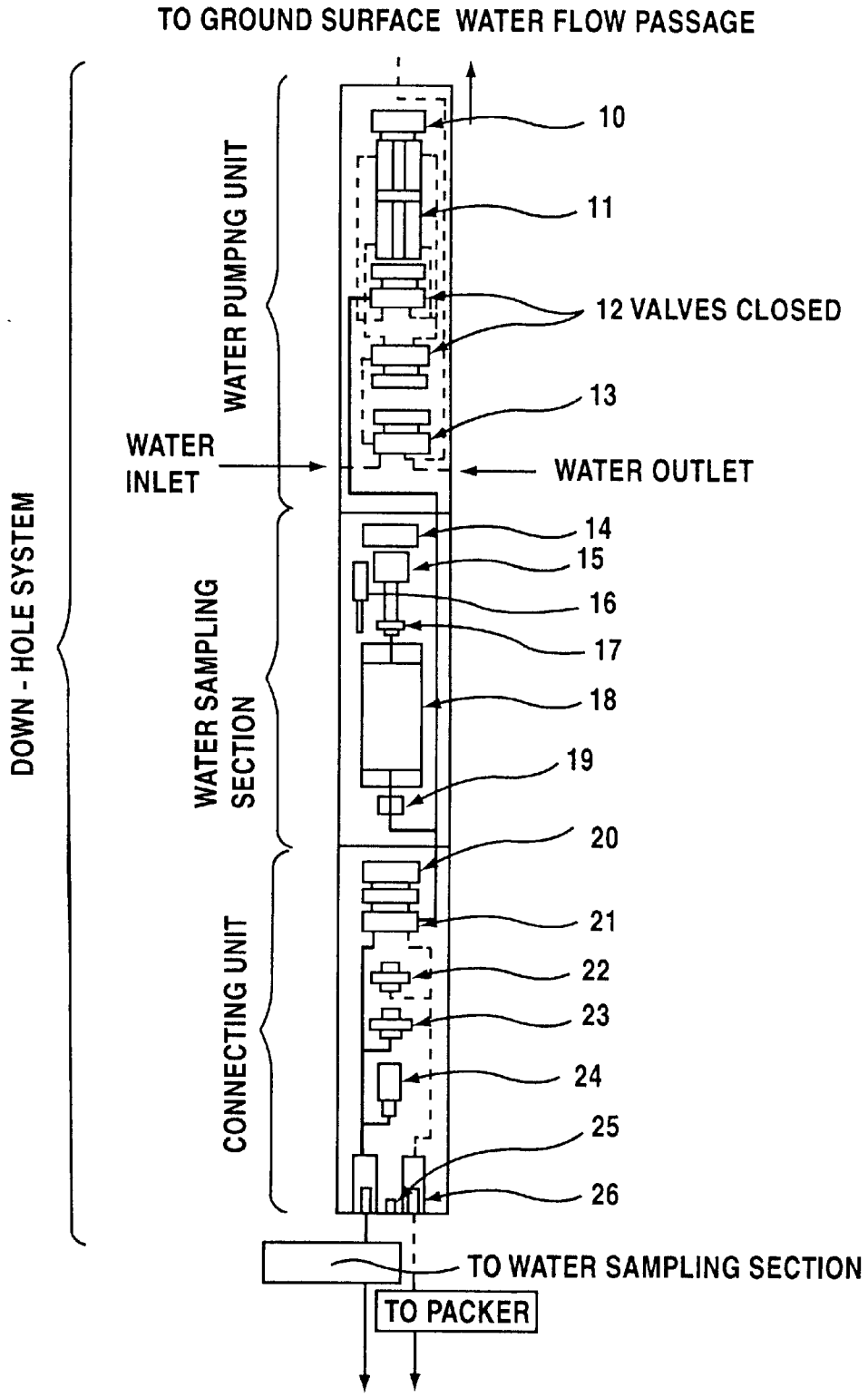
FIG. 10 shows a batch style water sampling water flow passage.

The water flow passage switching valve 21 in the connecting unit is switched to the water sampling section water flow passage. Then, the water flow passage switching valve 13 in the water pumping unit is closed, and the pump switching valve 12 is closed. Because the pump switching valve 12 is closed, the water flow passage is cut off in the water pumping unit. In this case, the water flow passage is shown by thick solid lines in FIG. 10. Next, the water sampling container 18 of the water sampling section is pushed out by the driving motor 15 until the double-sided needle 19 penetrates through it. As a result, the water sampling container and the water flow passage are connected with each other, and the formation water is introduced into the water sampling container through the concave connecting coupler 26 of the connecting unit and the water flow passage switching valve 21. In this case, it should be confirmed that the pressure in the water sampling container is increased to the same level as the formation water pressure and the formation water under in-situ condition has been sampled in the water sampling container. The downhole system is pulled up, and the water sampling container 18 is sampled and brought to the ground surface. The batch style water sampling is repeatedly performed until water volume sufficient for the survey will be sampled.

As described above, the packer system for limiting the water sampling section in the borehole and the downhole system for sampling water have independent arrangements, and these are inserted into or removed from each other inside the borehole. Therefore, once the packer has been expanded, the convex connecting coupler 6 is closed and the packer is maintained in expanded state even when the downhole system is separated, and the water sampling section is maintained until the packer is compressed. By this system arrangement, it is possible to sample the formation water repeatedly by the batch style water sampling method after the setting of the water sampling section has been completed. For example, in water sampling operation performed at an interval of several months, the downhole system may be stored on the ground surface and the formation water can be sampled by the batch style water sampling method when necessary.

Also, in case the batch style water sampling method is performed, it can be confirmed that the pressure in the water sampling container is in equilibrium with the water pressure condition originally found in the groundwater in the water sampling section by means of the water sampling pressure gauge installed immediately above the water sampling container 18. By finding this pressure, it is possible to identify the water sampling volume in the water sampling container using Boyle's law.

The perfectly closed water sampling container 18 brought to the ground surface is compact in size, being 120 cm in length and 35 mm in diameter, and it can be easily taken out from the downhole system. After it has been brought to the ground surface, the pressure in the water sampling container can be maintained and perfectly closed condition can be retained. Even when only the water sampling container is transported to the laboratory for chemical analysis, it is possible to analyze because the environmental condition where the formation water was present is still maintained.

The pump 11 of the water pumping unit is designed in such a manner that the packer can be expanded using the downhole water by simply switching the water flow passage switching valves 13 and 21. For this reason, the distance from the pump 11 to the packer is shortened compared with the conventional method to apply pressure from the ground surface, and the packer can be expanded more quickly. Also, the expansion pressure can be detected by the packer pressure gauge 22, and proper pressure setting can be made. Because the downhole water is used to inflate the packer, the environment where the groundwater was present is not disturbed at all even when the packer water leaks by accident.

The downhole system, serving as a main functioning unit in the borehole, is moved up or down inside the casing pipe 4 and is inserted into or removed from the packer system inside the hole immediately above the water sampling section. Even when collapse occurs in the borehole, the downhole system can be brought to the ground surface in reliable manner.

To carry out the work perfectly and efficiently, optical fiber cable incorporated in the composite cable 3 is used in signal system in order that the downhole system can be remotely controlled by electric signal and power supply only from the surface unit, that the observed data can be displayed at real time on the surface unit and that the signals are transmitted in perfect manner.

Next, description will be given on operating procedure of the system of the present invention.

[Insertion and installation of the system in the borehole]

The packer system and the casing pipe 4 are inserted into the borehole. After reaching the predetermined depth, these are fixed by the surface unit.

The downhole system is inserted into the casing pipe 4. In this case, delivery quantity of the composite cable 3 is measured by a cable length measuring device incorporated in the cable drum unit 2, and the downhole system is inserted until it reaches the predetermined depth.

When these procedures have been completed, numerical value on the range finder sent from the connecting unit of the downhole system is checked, and it is confirmed whether the downhole system and the packer system are connected together or not. If the connecting distance is not sufficient, the composite cable is delivered more, and it is confirmed that the two systems have been connected with each other.

When it is confirmed that the two systems have been connected, initial conditions of the packer pressure and pore water pressure are measured from the packer pressure gauge 22 and the pore water pressure gauge 23 incorporated in the connecting unit. When fluctuation of water level and stability of each of the pressure values have been confirmed, the installation of the system is completed.

[Setting of the measuring section]

The water flow passage switching valve 21 of the connecting unit is switched to the packer water flow passage.

The water flow passage switching valve 13 of the water pumping unit is switched, and supply line of packer expanding water is switched to the ground surface or to the downhole system.

The speed of the pump 11 is selected from the surface unit, and the pump 11 in the water pumping unit is operated in expanding direction.

While monitoring the packer pressure gauge 22 in the connecting unit, the pump 11 is operated until the required packer pressure is reached.

When the required packer pressure has been reached, the pump 11 is stopped, and the water flow passage switching valves 13 and 21 are closed.

The packer pressure gauge 22 and the formation water pressure gauge 23 are monitored, and it is confirmed that there is no leakage of packer pressure.

In case fluctuation of the packer pressure is observed due to creeping of packer rubber or other causes, the above procedure is repeated.

When these procedures have been completed, quantity of water injected to the packer is checked from operation counter value of the pump 11 sent from the water pumping unit.

By the above procedure, the water sampling section closed by the packer is set up at any desired position in the borehole.

[Continuous water sampling]

The water flow passage switching valve 21 in the connecting unit is switched to the water sampling section water flow passage.

The water flow passage switching valve 13 installed in the water pumping unit is switched to select the line of continuous water sampling to the ground surface or to the downhole system.

The speed of the pump 11 is selected from the ground surface, and the pump 11 in the water pumping unit is operated to the water discharging direction. In this case, pump speed exerts influence on the pore water pressure and the packer pressure depending on the condition of permeability in the water sampling section. While monitoring the packer pressure gauge 22 and the formation water pressure gauge 23, the optimal pump speed is set.

Referring to the operation counter of the pump 11 sent from the water pumping unit, the pump 11 is operated until the space in the water sampling section is completely filled with the formation water (several times to several tens of times as much as the volume of the water sampling section). Electric conductivity, pH, etc. of the groundwater sampled and brought to the ground surface are measured, and it is judged whether it is the downhole water or the formation water.

As soon as it is judged that the formation water is filled in the water sampling section, the pump 11 is stopped, and the valves are closed.

If the continuous water sampling volume is not sufficient, the above procedure is repeated.

By confirming restoration of the formation water pressure and the packer pressure, continuous water sampling procedure is completed.

[Batch style water sampling]

The water flow passage switching valve 21 in the connecting unit is switched over to the water sampling section water flow passage.

It is confirmed that the water flow passage switching valve 13 installed in the water pumping unit is closed.

By the pressure in a water sampling container gauge 17 installed on the water sampling unit, initial pressure in the water sampling container 18 is checked, and the water sampling container 18 is pushed by the driving motor 15 until the double-sided needle 19 penetrates it.

In this case, the amount of displacement necessary to penetrate is confirmed by the displacement gauge 16 installed on the water sampling unit.

Figure 11:
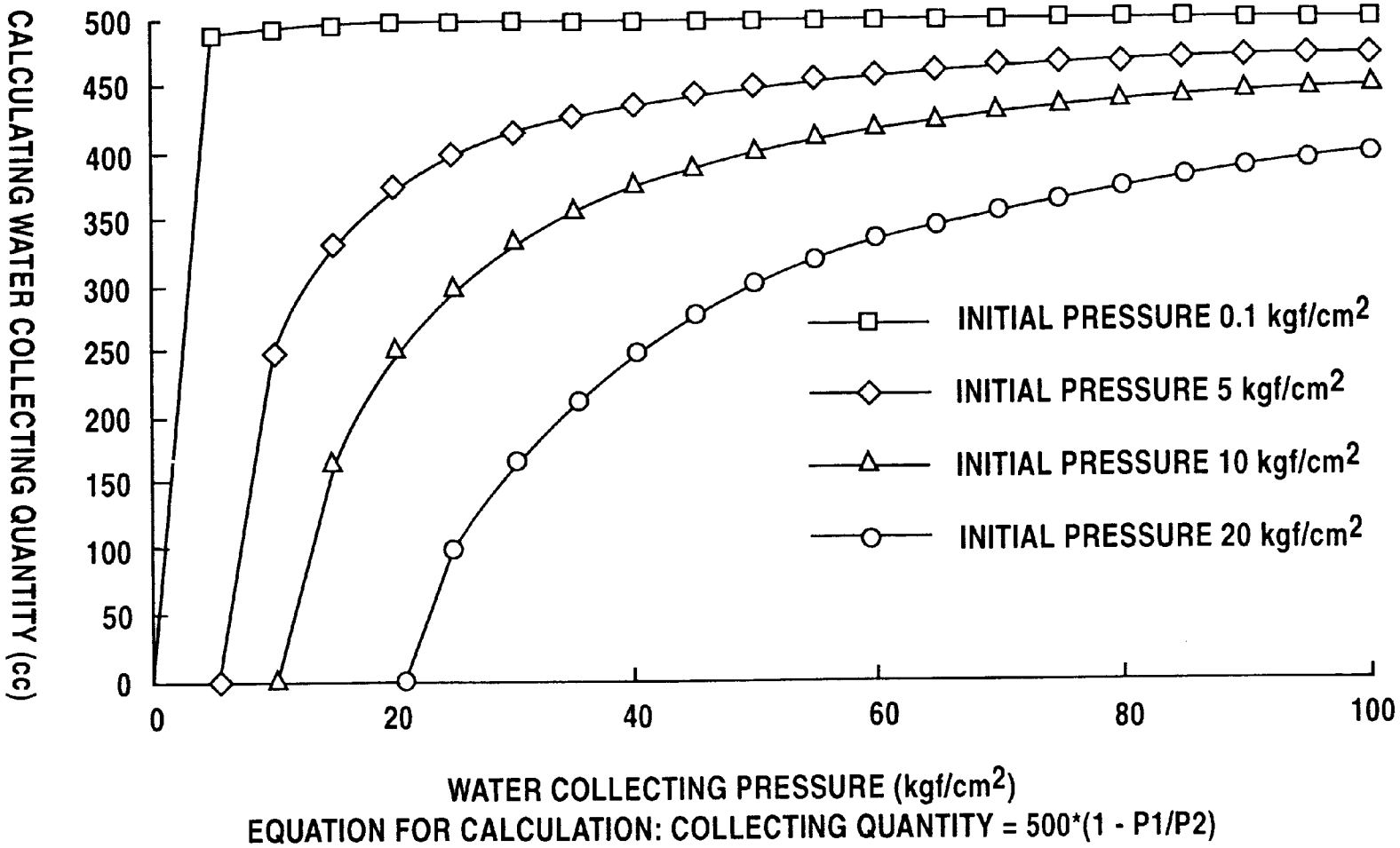
FIG. 11 is a diagram showing calculation examples of water sampling volume based on initial pressure of a water sampling container and pressure in a water sampling container.

It is confirmed that the pressure in the water sampling container has increased to the same level as the pore water pressure and that the formation water under in-situ condition has been sampled in the water sampling container. By observing this pressure, it is possible to identify water sampling volume in the water sampling container using Boyle's law. FIG. 11 is a diagram showing calculation examples of water sampling volume=500* (1−P1/P2) by initial pressure P1 and water sampling pressure P2. In case the initial pressure is low (0.1 kgf/cm$^2$), the pressure in a water sampling container is about 5 kgf/cm$^2$ , and the water sampling container (full with 500 cc) is filled with about 500 cc of the formation water. Then, the pressure in the water sampling container is increased until it keeps balance with the formation water in the water sampling section. Thus, it is evident that, from the time when about 500 cc of water has been introduced, pressure is increased in the water sampling container, but there is no moving of the formation water.

In this case, the formation water is quickly introduced into the container, and this may exert influence on the pore water pressure and the packer pressure. In some cases, it may be necessary to apply pressure in the water sampling container in advance.

When the above procedures have been completed, the driving motor 15 is operated and the double-sided needle 19 is withdrawn to cut off the water sampling container 18 from outside.

The downhole system is pulled up, and the water sampling container 18 is brought to the ground surface. The water sampling container 18 thus brought up can be transported with the formation water sealed in it under in-situ condition.

The above procedure is repeated until water quantity necessary for the survey is sampled.

[Compression of the packer]

A water flow passage similar to the water flow passage in expansion is set up, and the pump 11 is operated in compressing direction.

Based on the information of the operation counter in the pump 11, the pump is operated until the water quantity injected during expansion is sampled, and it is confirmed that the packer pressure is reduced to the initial pressure.

[Shifting of the survey point]

The downhole system is brought to the ground surface. If necessary, survey depth is changed and the procedures of [setting of the measuring section]–[compression of packer] are repeated.

[Recovery of the system]

The system is brought to the ground surface, and the survey is completed.

In the following, based on the results of experiments performed in a borehole, effectiveness of the system of the present invention will be described.

Figure 12:
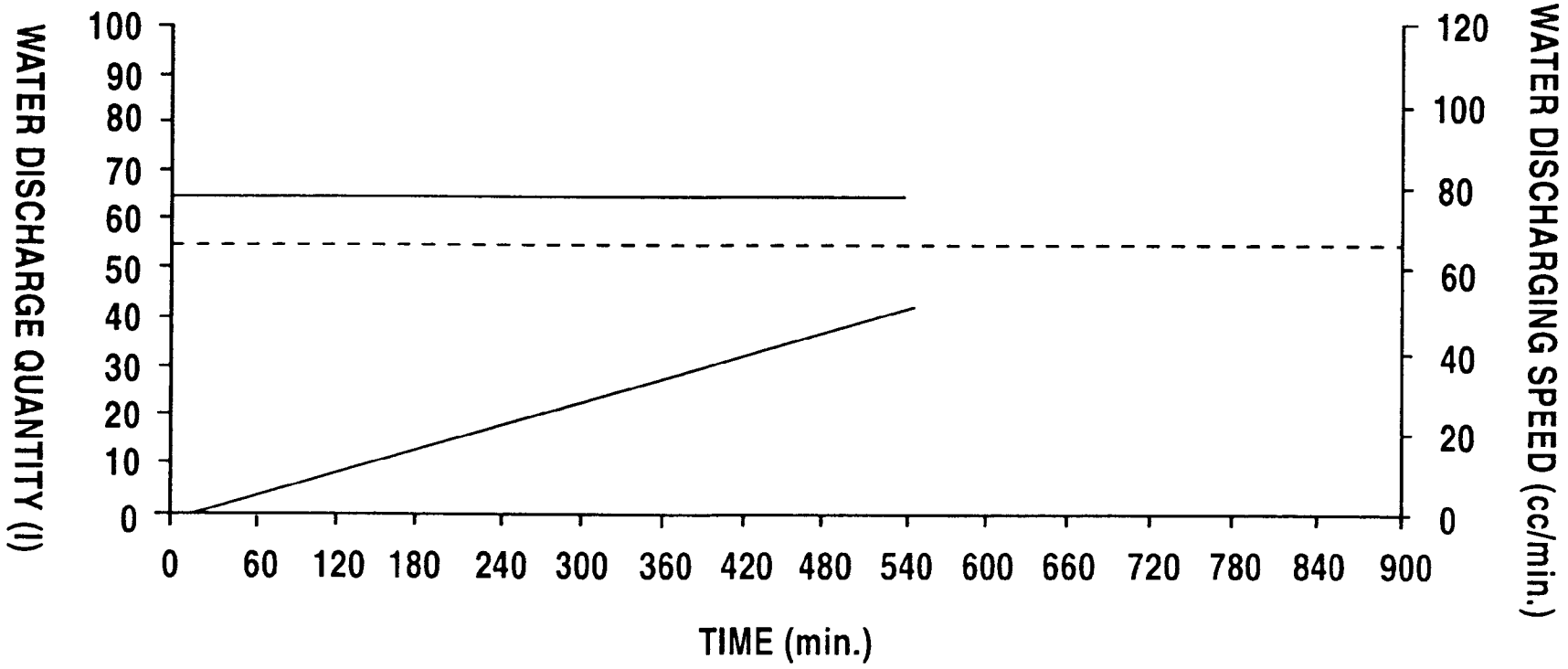
FIG. 12 is a diagram showing an example of observation data in a continuous water sampling test.

FIG. 12 shows an example of observation data on water discharge speed and water discharge quantity during continuous water sampling period. The diagram indicates that the water discharge speed was 78 cc/min. and that the water displacement was about 41.51 at the completion of water discharge test. Although not shown in the diagram, the pore water pressure was 93.33 kgf/cm$^2$, the packer pressure was 100.03 kgf/cm$^2$, and the packer effective pressure (packer pressure—pore water pressure) was 6.70 kgf/cm$^2$. In this way, the pore water pressure, the packer pressure, the water sampling volume during continuous water sampling, and the water pumping speed can be monitored at all times during the continuous water sampling period and the data can be continuously observed. In this example, it is evident that water is discharged at constant speed, and it is judged that no unreasonable load is applied on the pump during operation. With this function provided, accumulated water sampling volume during continuous water sampling or stability of packer pressure can be confirmed as necessary compared with the conventional technique.

Figure 13:
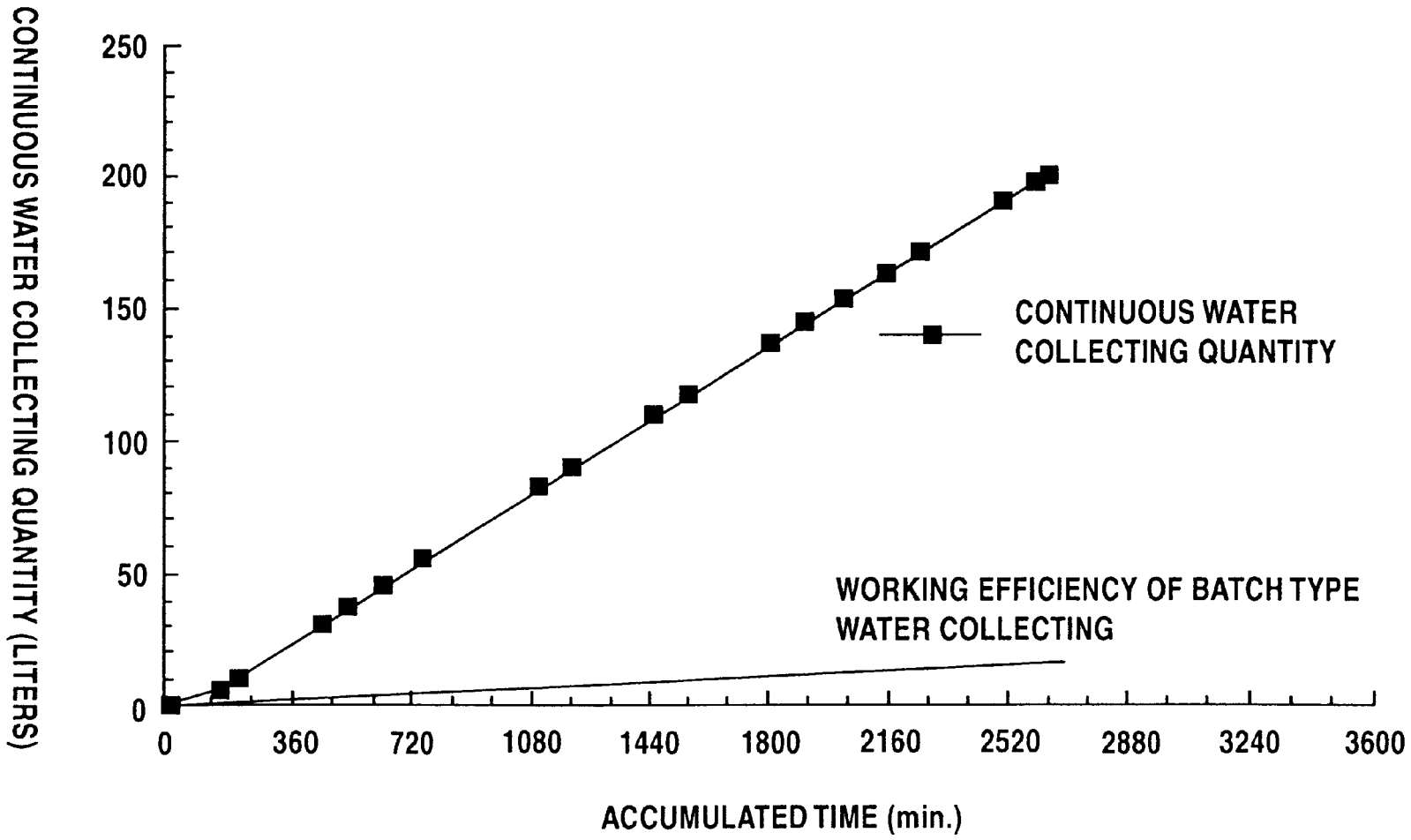
FIG. 13 is a diagram for explaining working efficiency in the continuous water sampling method.

Next, FIG. 13 represents an example of the result of the test showing improvement of working efficiency by the continuous water sampling method. In the diagram, actual results of accumulated water sampling volume when continuous water sampling method is performed at depth of 970 meters in the present system are compared with the estimated water sampling volume at the same depth calculated from the batch style water sampling method of the present system. When the data in elapsed time of 30 hours are compared, the water sampling volume by the continuous water sampling method is 130 liters, while it is as low as 10 liters by the batch style water sampling method.

This data suggests that, in the process to replace the groundwater in the water sampling section with the formation water, working efficiency is much higher in the continuous water sampling method of the present invention than the water sampling system based on the batch style water sampling method only.

Figure 14:
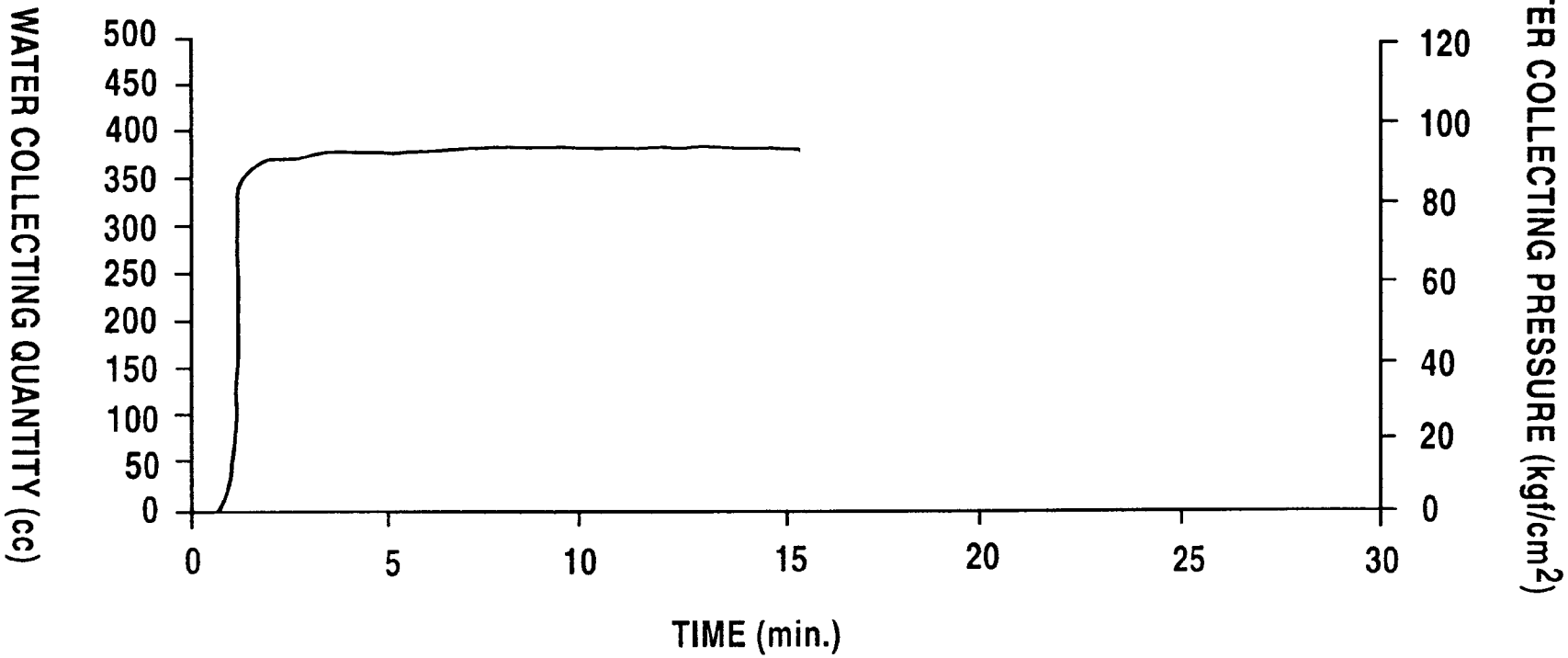
FIG. 14 shows an example of observation data during batch style water sampling period.

FIG. 14 shows an example of observation data during the batch style water sampling period. From the diagram, it is evident that penetration of the double-sided needle 19 into the water sampling container 18 was recognized 3 minutes after the starting of observation, and that pressure in the water sampling container kept equilibrium with water pressure environment which the water sampling section has originally maintained. The above observation data demonstrates that, in the batch style water sampling method used in the present invention, it can be confirmed that pressure in the water sampling container has reached equilibrium with water pressure environment where the formation water was present by the pressure observing function in the water sampling container.

Figure 15:
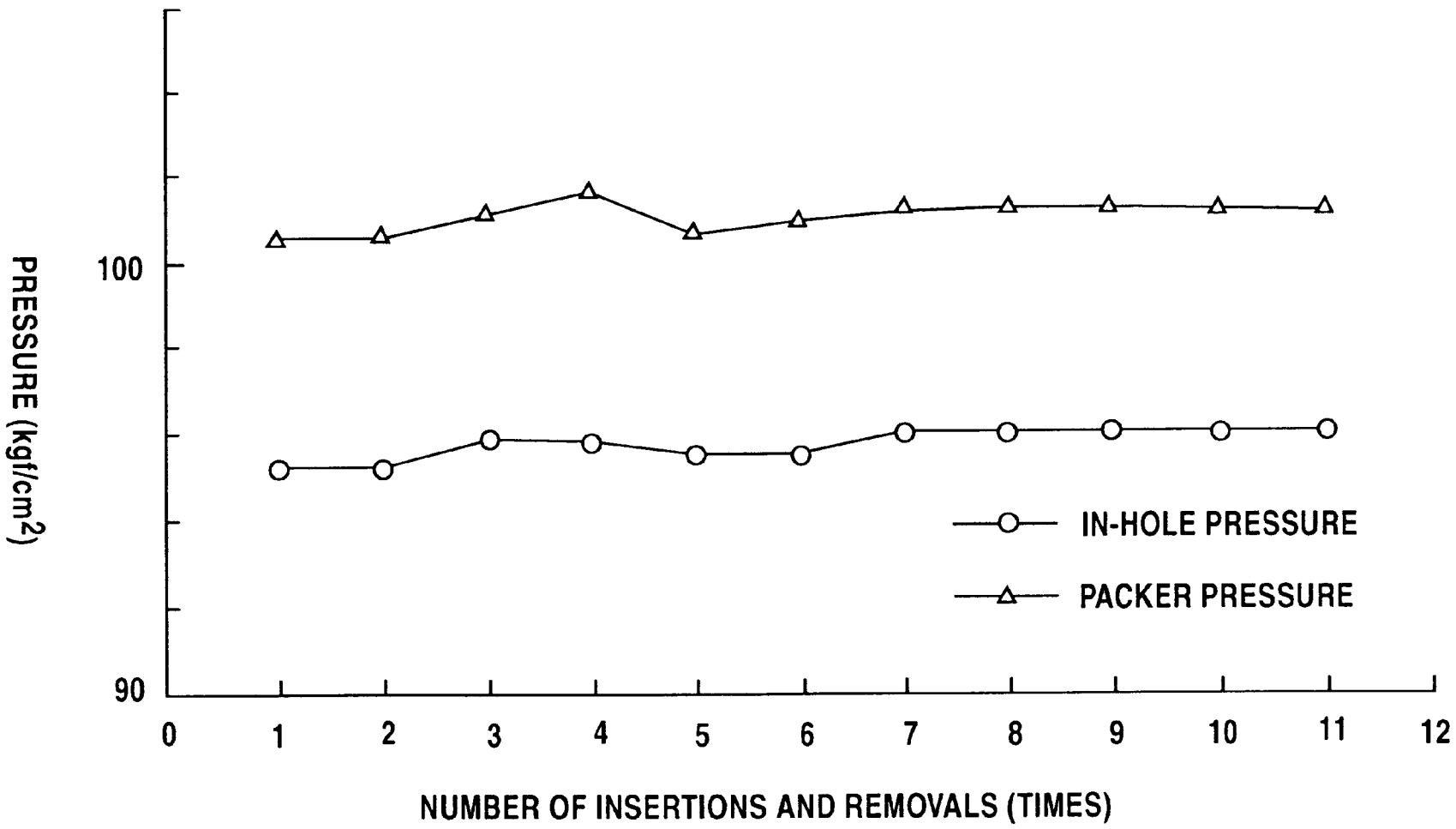
FIG. 15 is a diagram showing an example of observation of packer and pore water pressure changes with respect to the number of insertions and removals when the downhole system is repeatedly inserted and removed.

FIG. 15 shows an example of observation of the changes in packer pressure and formation water pressure with respect to the number of insertions or removals when the downhole system is inserted or removed repeatedly. In this diagram, some fluctuations of the packer pressure following the fluctuation of the pore water pressure in the water sampling section are recognized, but both pressures are kept almost at constant level. There is almost no leakage of the packer pressure due to insertion or removal of the downhole system, and it is judged that the pipings in the packer are maintained in closed condition.

These results suggest that the water sampling section is maintained by the packer even when the downhole system is repeatedly inserted and removed. This demonstrates the effectiveness and reliability of the connecting mechanism for the downhole system and the packer system in the present invention.

Figure 16:
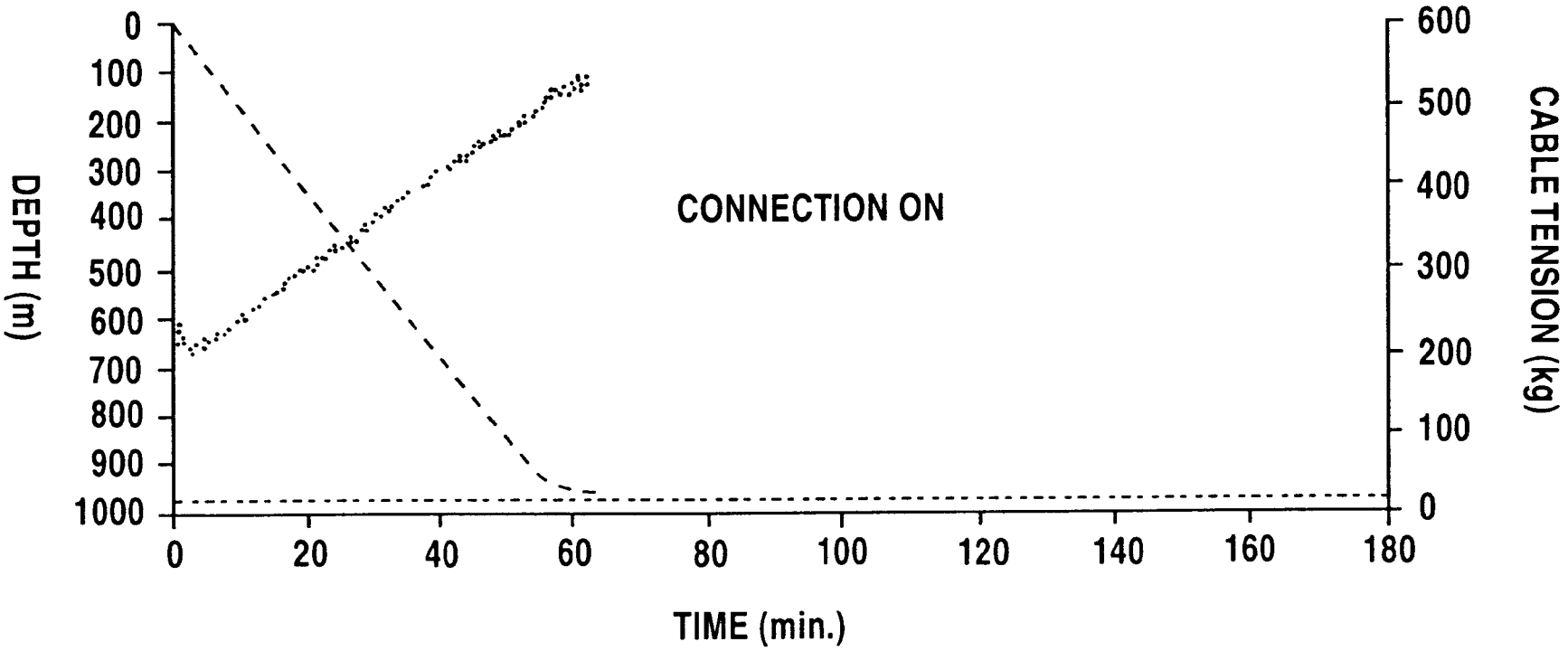
FIG. 16 is a diagram showing an example of observation results from insertion of the downhole system to its connection with the packer system in the hole.

FIG. 16 shows an example of observation results from the insertion of the downhole system to its connection with the packer system in the hole. The items of observation in this case include tension applied on the composite cable, pressure and temperature in the downhole system, and information on depth calculated based on the calculated results from the cable length measuring device (pulse counter) installed on the cable winding unit of the surface unit. These observation data are important in securing safety when the downhole system is moved up and down in the casing pipe, and it was confirmed that the system was normally functioning in the test at site.

From this diagram, it is possible to judge from the tension applied on the composite cable whether the downhole system has been connected with the packer system. Final connection is confirmed by the range finder installed in the connecting unit.

Figure 17:
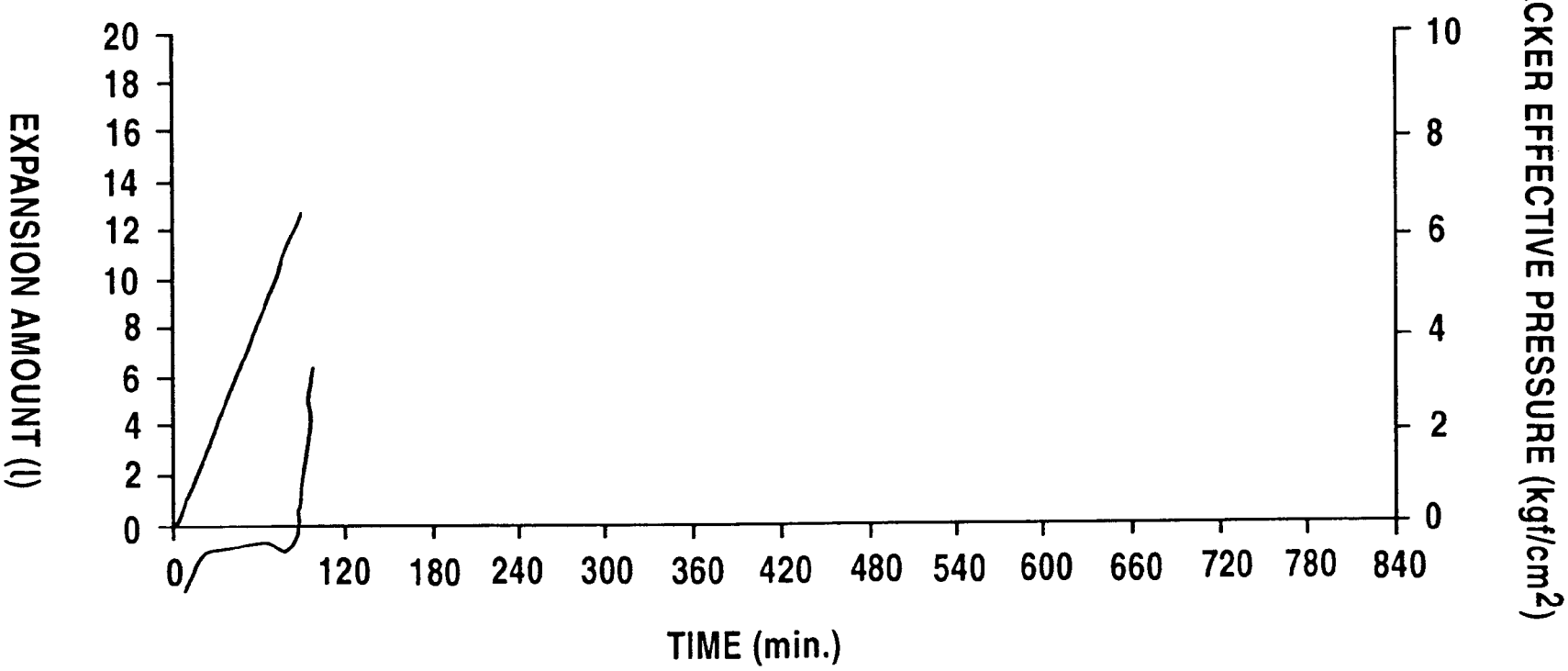
FIG. 17 shows an example of observation data when packers are expanded.

FIG. 17 shows an example of observation data when the packer is expanded. The straight line in the diagram shows water quantity supplied by the pump 11, and the curve indicates effective pressure of the packer (packer pressure—pore water pressure). In this system, the packer can be expanded by the use of the in-hole water in the borehole by switching the water flow passages of the two-way pump used in the continuous water sampling method. In the diagram, it is seen that the expansion amount of 13 liters necessary for expanding the packer is reached in about 2 hours. In the conventional method for applying pressure from ground surface, the time to reach the depth varies according to diameter of water supply hose and to water supply pressure, and simple comparison cannot be made. When compared with empirical average value (for about half a day), expansion amount has been reached at a speed by 2–3 times quicker than in the conventional method, and the time for expansion has been extensively shortened. Because the in-hole water is used, there is no risk of mixing of the water of different quality with the groundwater in the borehole. The problem of freezing in case where ground temperature reaches below the freezing point can also be eliminated.

Figure 18:
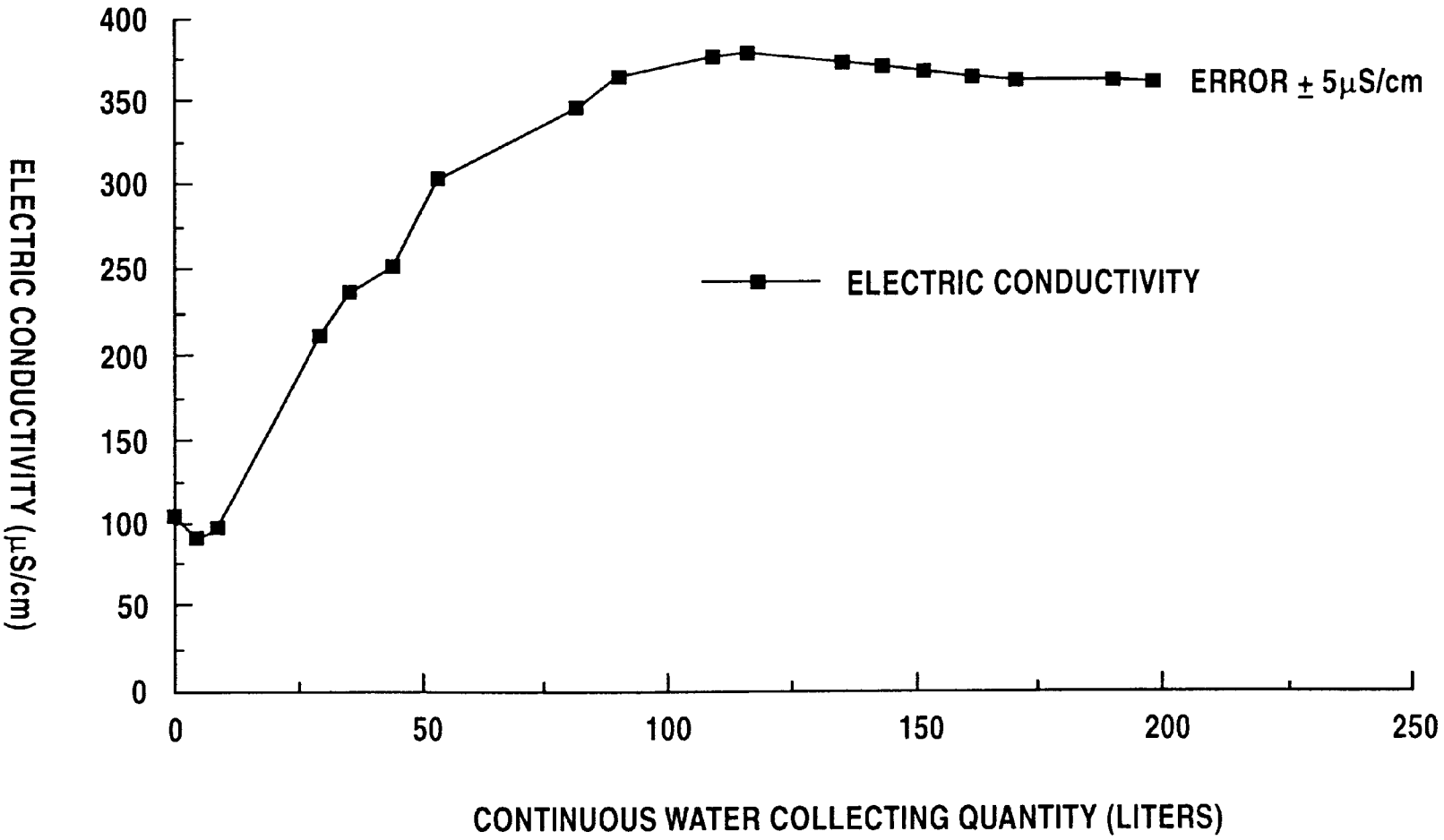
FIG. 18 shows relationship between continuously sampled water quantity and electric conductivity.

FIG. 18 shows relationship between continuous water sampling volume and electric conductivity. To determine electric conductivity, the groundwater sampled by continuous water sampling method was measured by a different analyzer. The stabilization of electric conductivity is an indicator showing that the water in the water sampling section is being replaced with the formation water by continuously sampling the downhole water in the water sampling section. In the following, comparison will be made between the results obtained by the system of the present invention and those obtained by the existing technique (batch style water sampling method) based on the results of the test performed at a depth of 970 meters in an actual borehole.

In the system of the present invention, working efficiency is improved by providing with functions of the continuous water sampling method and the batch style water sampling method in one downhole system. This is briefly summarized in FIG. 19. In the process of continuous water sampling, an example of the measurement of electric conductivity of the groundwater sampled and brought to the ground surface is as shown in FIG. 18. From the results, it may be interpreted that electric conductivity has reached almost the state of equilibrium from the time when continuous water sampling volume reached 120 liters and the water has been almost completely replaced with the formation water. In this test, continuous water sampling was carried out to about 201 liters to confirm the state of equilibrium. Thereafter, water sampling by the batch style water sampling method was performed by 10 times in total as shown in FIG. 20, and about 51 samples of the formation water under in-situ condition were obtained. The total time of the continuous water sampling and batch style water sampling was 4,148 minutes (about 69 hours).

Based on the above results, it is compared with the working time of a system equipped only with the batch style water sampling method.

Because there is no other existing system having the batch style water sampling method at a depth of 1,000 meters, average value (150 minutes) of the present system is used as the time required for one time water sampling based on the batch style water sampling method. 206 liters /0.5 liter×150 minutes=618,000 minutes (1,030 hours)

As it is evident from the results, compared with a system equipped only with the batch water sampling method, water sampling can be performed within the time of about 1/15, and it was demonstrated that working efficiency of the system of the present invention was higher. Also, the formation water obtained by the batch style water sampling method was sampled after confirming that the pressure in the water sampling container has reached the state of equilibrium with the water pressure in the water sampling section as already described, and the present system is also superior in terms of quality control. Further, FIG. 20 shows that the water sampling container can be brought to the ground surface after identifying water sampling quantity in the water sampling container and that the maximum water sampling volume (500 cc) per one operation can be reliably sampled.

The above description relates to working efficiency of the survey at one point, while water may be sampled regularly at the same water sampling section at an interval of several days to several months in the survey using water sampling system. In such survey, it is essential that the water sampling section in the borehole is maintained for long time and water must be sampled when necessary.

In the existing technique, however, there is no system, which is suitable for greater depth and is equipped with the batch style water sampling method and the continuous water sampling method in one downhole system and in which water sampling section in the borehole is maintained for long time and regular water sampling can be performed for long period. As described above, the system of the present invention is designed in such structure that expansion pressure of the packer can be maintained even when the downhole system is separated. Therefore, in case the system is applied for this type of survey, it is possible to sample the formation water immediately if the packer system and the casing pipe are left with the packer in expanded state in the borehole and if the downhole system is inserted into the hole whenever water is to be sampled.

What we claim is:

1. A packer type groundwater sampling system, comprising:

a casing pipe in which a packer system having an upper packer and a lower packer with a water sampling filter placed therebetween is installed at a bottom end of the casing pipe;

a downhole system comprising a connecting unit, a water sampling unit and a water pumping unit is inserted into the casing pipe and connected with the packer system by the connecting unit; and a control unit is installed on a ground surface and used for controlling the downhole system, wherein:

said connecting unit has a water sampling section water flow passage with a formation water pressure gauge connected thereto and a water flow passage switching valve for switching a packer water flow passage with a packer pressure gauge connected to said water sampling section water flow passage, said water sampling unit has a water sampling container whereby a line from the water flow passage switching valve of the connecting unit and the interior of said water sampling container are connected, and said water pumping unit has a water flow passage switching valve connected to a line from the water flow passage switching valve of the connecting unit and said water flow passage switching valve is used for switching the line from the connecting unit to the ground surface or to the downhole system and a pump, said pump being operative to be switched in two directions by a pump switching valve.

2. A packer type groundwater sampling system according to claim 1, wherein the connecting unit comprises a tapered portion being at a symmetrical position of ±180° at its bottom end and having a key groove to be connected with a guide key mounted on the casing pipe at its bottom end, and, when the downhole system is inserted and when said tapered portion and the guide key are brought into contact with each other, the connecting unit is rotated along the tapered portion until the guide key is engaged in the key groove.

3. A packer type groundwater sampling method according to claim 2, wherein a range finder for measuring the distance from the packer system is provided at the bottom end of the connecting unit.

4. A packer type groundwater sampling method, comprising the steps of:

installing a casing pipe in a borehole, said casing pipe having a packer system comprising an upper packer and a lower packer with a water sampling section disposed therebetween and being installed at a bottom end of the casing pipe;

inserting a downhole system into the casing pipe and connecting it to the packer system by a connecting unit, said downhole system comprising a connecting unit having a water flow passage switching valve for switching between a water sampling section water flow passage where a formation water pressure gauge is connected and a packer water flow passage where a packer pressure gauge is connected, a water sampling unit having a water sampling container with a pressure therein measured by the formation water pressure gauge, and a water pumping unit having a pump connected to a line from the water flow passage switching valve from the connecting unit and having a water flow passage switching valve to switch the line from the connecting unit to the ground surface or to the downhole system and a pump, said pump being operative to be switched in two directions by a pump switching valve;

switching over the water flow passage switching valve of the connecting unit to the packer unit, connecting the water flow passage switching valve of the water pumping unit to the ground surface or to the downhole system, and setting the water sampling section by increasing packer pressure to a predetermined value by the pump and by expanding the upper and the lower packers;

switching the water flow passage switching valve of the connecting unit to the water sampling section water flow passage, connecting the water flow passage switching valve of the water pumping unit to the ground surface or to the downhole system and continuously sampling water until the water sampling section is filled with formation water by operating the pump in water discharging direction;

stopping the pump when it is judged that downhole water in the water sampling section has been replaced with the formation water and closing the water flow passage switching valves of the water pumping unit and of the connecting unit; and sampling water received in said water sampling section.

5. A packer type groundwater sampling method according to claim 4, wherein said sampling step includes continuous water sampling using the water sampling unit.

6. A packer type groundwater sampling method according to claim 4, wherein said sampling step includes batch style water sampling using the water sampling unit.

7. A packer type groundwater sampling method according to claim 6, wherein the batch style water sampling by the water sampling unit includes switching the water flow passage switching valve of the connecting unit to the water sampling section water flow passage, to close the water flow passage switching valve of the water pumping unit, to lower the water sampling container to establish communication between the water sampling section and the water sampling container, and to confirm and sample water by checking that pressure in the water sampling container is equalized with the formation water pressure.

8. A packer type groundwater sampling method according to claim 7, wherein expanded conditions of the upper packer and the lower packer are maintained to maintain the position of the water sampling section, and water sampling using the same water sampling section is repeatedly performed by moving the downhole system up and down.

* * * * *